United States Patent [19]

Ohya et al.

[11] Patent Number: 5,015,563

[45] **Date of Patent: * May 14, 1991**

[54] SILVER HALIDE LIGHT-SENSITIVE COLOR PHOTOGRAPHIC MATERIAL SUITABLE FOR RAPID PROCESSING COMPRISING A MERCAPTO OR AN AZAINDENE COMPOUND

[75] Inventors: Yukio Ohya; Yoshiyuki Nonaka, both of Hino, Japan

[73] Assignee: Konica Corporation, Tokyo, Japan

[ * ] Notice: The portion of the term of this patent subsequent to Mar. 27, 2007 has been disclaimed.

[21] Appl. No.: 535,992

[22] Filed: Jun. 7, 1990

Related U.S. Application Data

[63] Continuation of Ser. No. 348,080, May 3, 1989, abandoned, which is a continuation of Ser. No. 80,552, Jul. 31, 1987, abandoned.

[30] Foreign Application Priority Data

Aug. 7, 1986 [JP] Japan ..... 61-185917

[51] Int. Cl.[5] ..... G03C 1/34; G03C 7/26; G03C 7/32

[52] U.S. Cl. ..... 430/546; 430/551; 430/567; 430/569; 430/607; 430/611; 430/613

[58] Field of Search ..... 430/546, 551, 567, 569, 430/607, 611, 613

[56] References Cited

U.S. PATENT DOCUMENTS

| | | | |
|---|---|---|---|
| 2,843,491 | 7/1958 | Allen et al. | 430/611 |
| 3,519,426 | 7/1970 | Halwig | 430/569 |
| 4,269,927 | 5/1981 | Atwell | 430/605 |
| 4,332,888 | 6/1982 | Corben | 430/606 |
| 4,564,591 | 1/1986 | Tanaka et al. | 430/567 |
| 4,609,618 | 9/1986 | Sasaki et al. | 430/546 |
| 4,623,616 | 11/1988 | Takada et al. | 430/545 |

FOREIGN PATENT DOCUMENTS

| | | | |
|---|---|---|---|
| 156377 | 10/1985 | European Pat. Off. . | |
| 0208146 | 1/1987 | European Pat. Off. | 430/607 |
| 1565503 | 4/1980 | United Kingdom . | |
| 2041356 | 9/1980 | United Kingdom | 430/611 |

OTHER PUBLICATIONS

Research Disclosure #17643, "Photographic Silver Halide . . . ", 12/78, pp. 22–25.

E. J. Birr; "Stabilization of Photographic Silver Halide Emulsions" 1st edition, 1974, Focal Press, London G. B. pages 58 and 81.

*Primary Examiner*—Charles L. Bowers, Jr.
*Assistant Examiner*—Parick A. Doody
*Attorney, Agent, or Firm*—Jordan B. Bierman

[57] ABSTRACT

A light-sensitive silver halide photographic material suitably applicable to rapid processing with well-restrained fogging, color fading and degradation in the contrast is disclosed. The material comprises a reflective support and, provided thereon, at least one light-sensitive silver halide emulsion layer which contains (1) silver chloride or silver chlorobromide emulsion of which silver chloride content is not less than 90 mole % and said silver chloride or silver chlorobromide emulsion has been prepared by the addition of a heterocyclic mercapto compound or an azaindene compound during the period of formation of silver halide grains contained therein, (2) a dye-forming coupler and (3) a high-boiling organic solvent of which dielectric constant is not more than 6.

14 Claims, No Drawings

SILVER HALIDE LIGHT-SENSITIVE COLOR PHOTOGRAPHIC MATERIAL SUITABLE FOR RAPID PROCESSING COMPRISING A MERCAPTO OR AN AZAINDENE COMPOUND

This application is a continuation of application Ser. No. 348,080, filed May 3, 1989, now abandoned, which is a continuation-in-part, of application Ser. No. 080,552, filed July 31, 1987, now abandoned.

FIELD OF THE INVENTION

The present invention relates to a silver halide light-sensitive color photographic material, and more particularly, this invention provides a silver halide light-sensitive color photographic material which is capable of being processed rapidly, excellent in the antifogging effect, satisfactory in the color preservability, and capable of giving a highcontrast gradation-having images.

BACKGROUND OF THE INVENTION

The light-sensitive photographic material field requires a silver halide light-sensitive color photographic material which has satisfactory photographic characteristics, which is capable of being processed rapidly, and which enables to obtain high-contrast gradation-having images.

For example, as regards the rapid processing, although silver halide photographic materials were conventionally subjected to the running processing by the automatic processors installed in the individual photofinishers' laboratories, as a part of improving the processing service to users, those photographic materials accepted for processing has been required to be processed to be returned to the users within the day of the accepted date, and besides, even faster return of them; as fast as within several hours after the acceptance, has lately been needed, and thus the development of silver halide color photographic materials that can be processed even more rapidly are urgently needed.

It is known that the use of a silver chloride emulsion is useful as technical means for obtaining such rapidly processable silver halide color photographic materials.

However, the emulsion of silver chloride or of a high silver chloride content, although it can be rapidly processed, is disadvantageous because of its high fog.

On the other hand, attempts are made to obtain a light-sensitive material having its photographic characteristics improved by the addition of a heterocyclic mercapto compound or tetrazaindene compound at the time of preparing its silver halide grains.

Such the prior art will be briefed below:

The processes for preparaing silver halide grains are generically called 'physical ripening', which are comprised of the processes of producing grains, growing the grains, and desalting and redispersiing the grains, or of the processes of growing grains in advance produced, and desalting and redispersing the grains. It is known for long that, in such the preparation of silver halide grains, a compound known as a restrainer to those in the art is added to silver halide at the time of the growth of its grains. However, the prior art that a restrainer is added at the time of the formation of high-silver-chloride-content silver halide grains is used only for changing the crystal habit of the grains as seen in, for example, 'The Journal of Photographic Science' Vol.21, p.39 (1973).

Naturally, the above prior art suggests nothing about the prevention of fog, so that it describes no measures therefor.

On the other hand, as regards the color preservability, there are known techniques to use a high-boiling organic solvent at the time of the coupler dissolution in order to increase the fastness of the dye image produced in the color developing system. The technique will then be described: A silver halide photographic material is imagewise exposed and then color-developed, whereby a dye image is formed, but the obtained dye image is desired to have a high fastness against light, heat and moisture. The fastness of the dye image is subject to various factors, and particularly the dye image is knwon to be dependent largely upon the natures of a dye-forming coupler that forms a dye in its reaction with a color developing agent and of a high-boiling organic solvent for use in dissolving the dye-forming coupler. In the selection of a dye-forming coupler, however, although the fastness of the resulting dye is of course important, it is essential for the coupler to form a dye having a satisfactory absorption characteristic for color reproduction, and further it is desirable for the coupler to have a high color-forming efficiency and a high stability in the solvent used, so that the selectable range of a dye-forming coupler has its limit. For this reason, there is a limit to the improvement of the fastness by the selection of a dye-forming coupler. On the other hand, the high-boiling solvent for use in dissolving the dye-forming coupler also has an important effect upon the fastness of the resulting dye therefrom; Japanese Patent Publication Open to Public Inspection (hereinafter referred to as Japanese Patent O.P.I. Publication) No. 205447/1985 discloses the improvement on the fastness of dye-forming couplers by use of a specific dielectric constant-having high-boiling solvent.

However, in a light-sensitive material which uses the above publication-disclosed high-boiling organic solvent, the image formed by the dye-forming coupler dissolved by the solvent, although improved on its fastness, shows its gradation is lowered, and its fog also comes into question.

That is, in order to develop a silver halide light-sensitive material adaptable to rapid processing and excellent in the dye image preservability, we used a high-boiling solvent that is described in Japanese Patent O.P.I. Publication No. 205447/1985 in mere combination with the foregoing high-silver chloride-content silver halide. As a result, it has now been found that the resulting dye image, although excellent in its preservability, has the problem that its gradation in the non-aged characteristics is soft and its fog is increased.

As has been described above, a technique is now desired which makes possible to obtain a silver halide color photographic material which produces little or no fog, which is excellent in the image fastness as well as in the color preservability, and of which the gradation of the image formed by the coupler is high-contrast, on condition that the light-sensitive material can be processed much faster than ever.

SUMMARY OF THE INVENTION

The present invention specifically relates to a light-sensitive silver halide photographic material comprising a reflective support having thereon at least one light-sensitive silver halide emulsion layer containing silver chloride or silver chlorobromide emulsion of which silver chloride content is not less than 90 mole %, said silver chloride or silver chlorobromide emulsion having been prepared by the addition of a heterocyclic mercapto compound or an azaindene compound during the period of formation of silver halide grains contained therein, a dye-forming coupler and a high-boiling organic solvent of which dielectric constant is not more than 6.

DETAILED DESCRIPTION OF THE INVENTION

The above light-sensitive material of this invention has been accomplished on the basis of the unexpected facts found by us that, in the formation of a silver chloride emulsion or a silver chlorobromide emulsion whose silver chloride content is not less than 90 mole %, if the restrainer of this invention is added at the time of forming silver halide grains, for example, in the course of growing silver halide grains, then the fog of the obtained light-sensitive material is restrained.

Also, in this invention, since at least one of the silver halide emulsion layers contains a high-boiling solvent having a dielectric constant of not more than 6, it has the advantage that the fastness of the resulting dye image is high, and at the same time the deterioration of the gradation in question where a solvent is used may be solved by the addition of the restrainer of this invention. In addition, we have now found that the fog-restraining effect obtained by the addition of the restrainer of this invention at the time of forming the above-mentioned grains can be even more raised by the incorporation of the high-boiling solvent having a dielectric constant of not more than 6.

The incorporation of the high-boiling solvent may be made in the manner of dissolving couplers; for example, a coupler is dissolved in a low-boiling solvent, and after that the above high-boiling solvent may be added to the coupler.

The construction of the present invention will be illustrated in detail below:

In this invention, the restraininger of this invention is added to silver halide at the time of forming the grains thereof. The addition at the time of forming the grains is the addition in the production of the grains in the course of the foregoing physical ripening and/or in the course of the growth of the grains; i.e., the addition may be made at a discretional point of time during the production of the grains or during the growth of the grains; the addition at any point of time during the described process may be effective.

To be more precise, in the formation of the grains a soluble silver salt and a halide solution are added, and the addition of the restraining agent of this invention may be made at any discretionary point of time during the period while the soluble silver salt and the halide solution are being added. If the restrainer of this invention is added after the formation of the grains (i.e., after completion of the addition of the soluble silver salt and the halide solution), no effect of this invention can be obtained.

The heterocyclic mercapto compound and azaindene compound to be used in this invention will be subsequently explained.

As for the heterocyclic mercapto compound of this invention, any arbitrary compound may be used as long as it has at least one mercapto group and at least one heterocyclic ring. Suitably usable heterocyclic mercapto compounds in this invention are those having the following Formula [I]:

Formula [I]

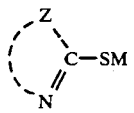

wherein Z is a group of atoms necessary to form a 5 or 6-member heterocyclic ring comprising atoms such as carbon, nitrogen, oxygen, sulfur, selenium. etc., the heterocyclic ring being allowed to be condensed; and M is a hydrogen atom, an alakali metallic atom, or an ammonium group.

Examples of the heterocyclic ring include pyridine, pyrimidine, imidazole, benzimidazole, naphthoimidazole, oxazole, benzoxazole, naphthoxazole, thiazole, benzothiazole, naphthothizaole. selenazole, benzoselenazole, naphthoselenazole, triazole, oxadiazole, thiadiazole, triazine, tetrazole. and purine, which each may have a substituent (including a substituting atom; the same shall apply hereinafter). Those azaindene compounds having the above SM group may also be suitably used, the SM group-having compounds being regarded as mercapto compounds for convenience' sake in this invention.

The substituent to these heterocyclic rings is an aromatic or aliphatic group, hydroxy group, alkoxy group, aryloxy group, amino group, nitro group, halogen atom, carboxyl group or a salt thereof, sulfo group or a salt thereof, mercapto group, alkylmercapto group, acylamino group, sulfamoyl group, sulfoamino group, carbamoyl group or the like. The heterocyclic group may be substituted by any of these groups.

The compounds particularly suitably usable in this invention among the compounds having Formula [I] are those having the following Formulas [II], [III]and [IV]):

Formula [II]

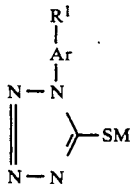

wherein Ar is a phenyl, naphthyl or cyclohexyl group; $R^1$ is an organic group substitutable to the Ar group or a hydrogen atom; M is a hydrogen atom, an alkali metallic atom or an ammonium group.

Formula [III]

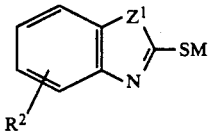

wherein $Z^1$ is a sulfur atom, oxygen atom, selenium atom or

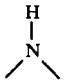

group: and $R^3$ is a substitutable organic group or a hydrogen atom; and M is as defined in the above.

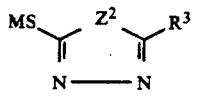

Formula [IV]

wherein $Z^3$ is a sulfur atom, oxygen atom, selenium atom or N—$R^4$, wherein $R^4$ is a hydrogen atom, an alkyl, alkenyl, cycloalkyl, aryl or aralkyl group or $COR^5$, $SO2R^5$, $NHCOR^5$ or $NHSO_2R^5$ group, wherein $R^5$ is an alkyl or aryl group; and $R^3$ is a substitutable organic group.

In the above Formulae [II] through [IV], the substitutable organic group is a group such as an aromatic or aliphatic group, hydroxy group, alkoxy group, aryloxy group, amino group, nitro group, halogen atom, carboxyl group or a salt thereof, sulfo group or a salt thereof, mercapto group, alkyl mercapto group, acylamino group, sulfamoyl group, sulfoamino group, carbamoyl group, heterocyclic group, or the like.

The following are examples of the compounds having Formulas [II] through [IV], but the present invention is not limited by the examples.

Exemplified Compounds of Formula [II]:

(S-1)

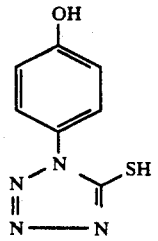

(S-2)

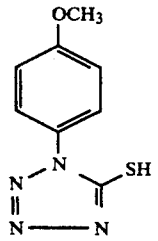

(S-3)

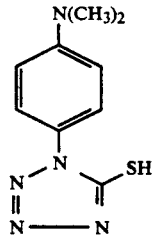

(S-4)

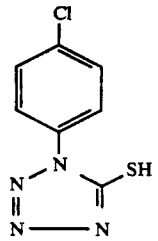

-continued

Exemplified Compounds of Formula [II]:

(S-5)

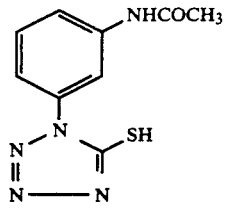

(S-6)

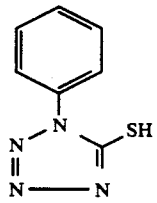

(S-7)

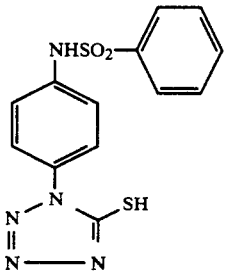

(S-8)

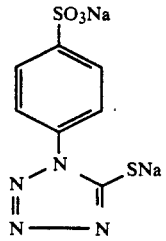

(S-9)

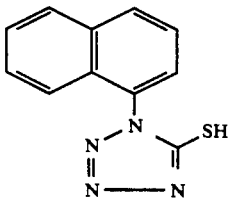

(S-10)

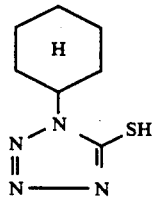

(S-11)

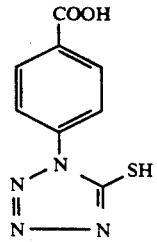

-continued
Exemplified Compounds of Formula [II]:
(S-12)
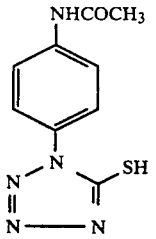
Exemplified Compounds of Formula [III]:
(S-13)
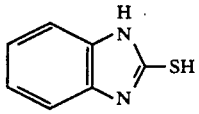
(S-14)
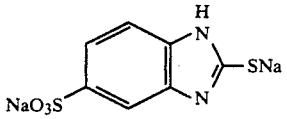
(S-15)
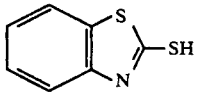
(S-16)
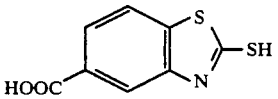
(S-17)
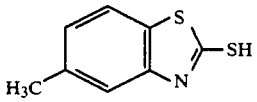
(S-18)
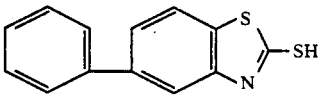
(S-19)
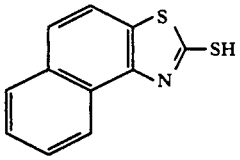
(S-20)
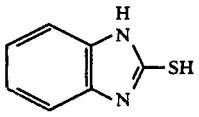
(S-21)
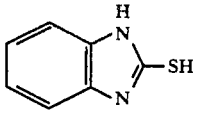
(S-22)
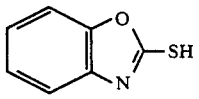
-continued
Exemplified Compounds of Formula [II]:
(S-23)
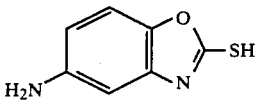
(S-24)
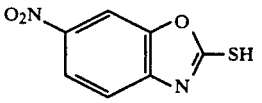
(S-25)
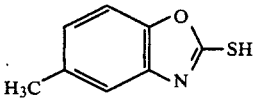
(S-26)
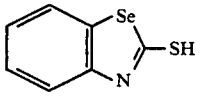
Exemplified Compounds of Formula [IV]:
(S-27)
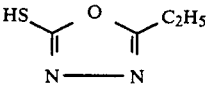
(S-28)
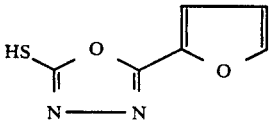
(S-29)
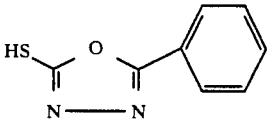
(S-30)
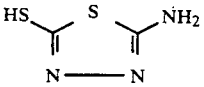
(S-31)
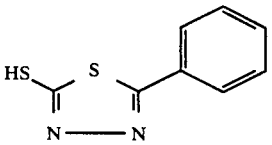
(S-32)
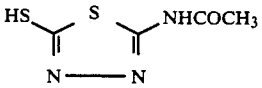
(S-33)
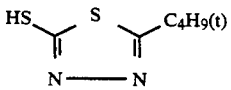
(S-34)
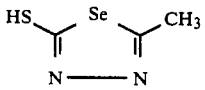
(S-35)
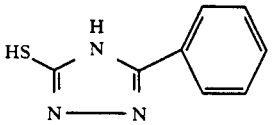

-continued

Exemplified Compounds of Formula [II]:

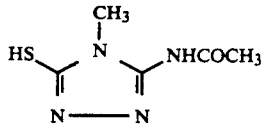

(S-36)

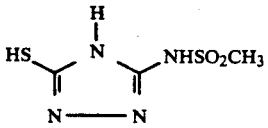

(S-37)

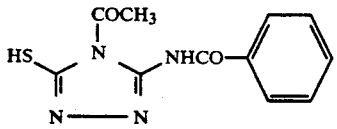

(S-38)

As the azaindene compound, tetrazaindene compounds may be suitably used. The particularly useful tetrazaindene compounds are those having the following Formulas (1), (2), (3), (4) and (5):

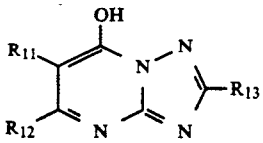

Formula (1)

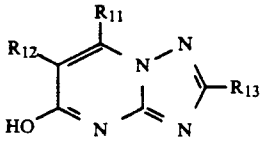

Formula (2)

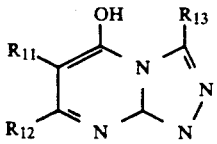

Formula (3)

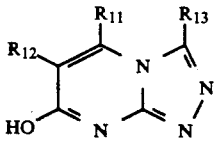

Formula (4)

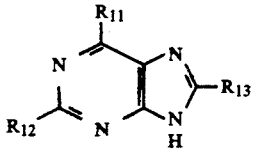

Formula (5)

In thse formulas, $R_{11}$, $R_{12}$ and $R_{13}$ may be either the same or different and each is a hydrogen atom, a halogen atom, an amino group, an amino group derivative, an alkyl group, an alkyl group derivative, an aryl group, an aryl group derivative, a cycloalkyl group, a cycloalkyl group derivative, or a —CONH—$R_{14}$ group (wherein $R_{14}$ is a hydrogen atom, an alkyl or amino group, an alkyl group derivative, an amino group derivative, a halogen atom, a cycloalkyl group, a cycloalkyl group derivative, aryl group or a aryl group derivative), provided that the $R_{11}$ and $R_{12}$ may combine with each other to form a ring (such as a 5 to 7-member carbocyclic or heterocyclic ring).

Examples of the alkyl group represented by the $R_{11}$ through $R_{14}$ include methyl group, ethyl group, propyl group, pentyl group, hexyl group, octyl group, isopropyl group, sec-butyl group, t-butyl group, 2-norbornyl group, and the like. Examples of the alkyl group derivative include. e.g.. aromatic residue-substituted (may be substituted through a divalent linkage group such as —NHCO—) alkyl groups (such as benzyl group, phenethyl group, benzhydryl group, 1-naphthylmethyl group, 3-phenylbutyl group, benzoylaminoethyl group, etc.), alkoxy-substituted alkyl groups (such as methoxymethyl group, 2-methoxyethyl group, 3-ethoxypropyl group, 4-methoxybutyl group, etc.), those alkyl groups substituted by a halogen atom, hydroxy group, carboxy group, alkoxycarbonyl group or by substituted or unsubstituted amino group (such as monochloromethyl group, hydroxymethyl group, 3-hydroxybutyl group, carboxymethyl group, 2-carboxyethyl group, 2-(methoxycarbonyl)ethyl group, aminomethyl group, diethylaminomethyl group, etc.), cycloalkyl-substituted alkyl groups (such as cyclopentylmethyl group, etc.), and those alkyl groups substituted by a monovalent group obtained by removing one hydrogen atom from those compounds having the above Formulas (1) through (5).

Examples of the aryl group represented by the $R_{11}$ through $R_{14}$ include phenyl group, 1-naphthyl group, and the like. Examples of the aryl group derivative include, e.g., p-tolyl group, m-ethylphenyl group, m-cumenyl group, mesityl group, 2,3-xylyl group, p-chlorophenyl group, o-bromophenyl group, p-hydroxyphenyl group, 1-hydroxy-2-naphthyl group, m-methoxyphenyl group, p-ethoxyphenyl group, p-carboxyphenyl group, o-(methoxycarbonyl)phenyl group, m-(ethoxycarbonyl)phenyl group, 4-carboxy-1-naphthyl group, and the like.

Examples of the cycloalkyl group represented by the $R_{11}$ through $R_{14}$ include cycloheptyl group, cyclopentyl group, cyclohexyl group, and the like. Examples of the cycloalkyl group derivative include methylcyclohexyl group, and the like. The halogen atom represented by the $R_{11}$ through $R_{14}$ is fluorine, chlorine, bromine or iodine. Examples of the amino group derivative include butylamino group, diethylamino group, anilino group, and the like.

The following are exmaples of the azaindene compound usable in this invention, but it goes without saying that this invention is not limited by the examples.

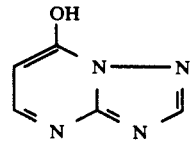

(S-39)

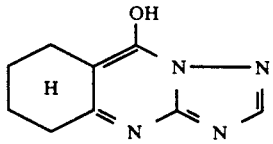

(S-40)

-continued
(S-41)
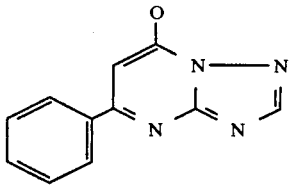
(S-42)
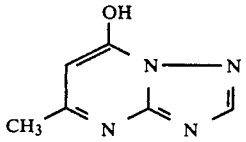
(S-43)
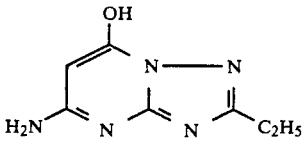
(S-44)
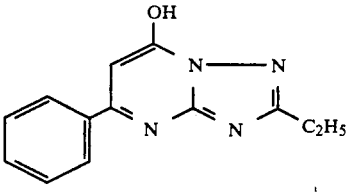
(S-45)
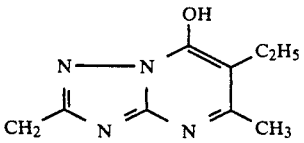
(S-46)
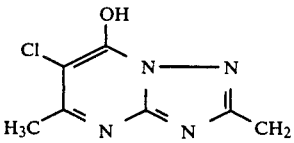
(S-47)
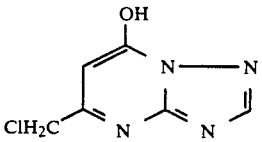
(S-48)
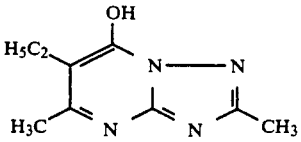
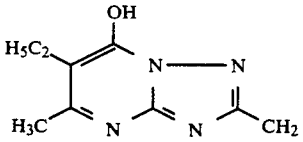
(S-49)
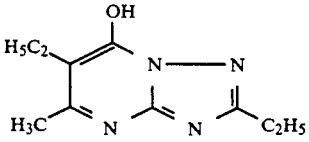
-continued
(S-50)
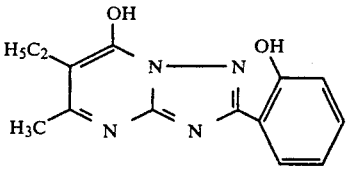
(S-51)
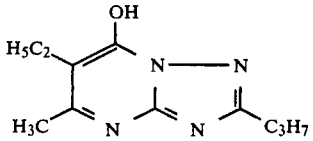
(S-52)
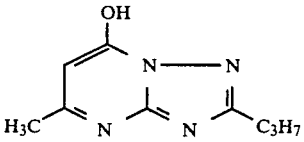
(S-53)
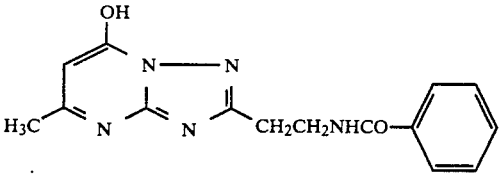
(S-54)
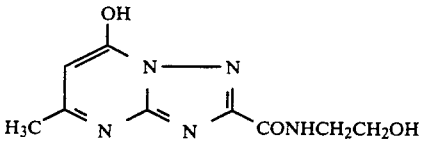
(S-55)
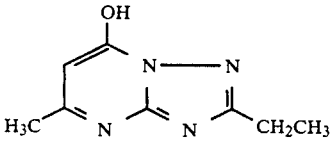
(S-56)
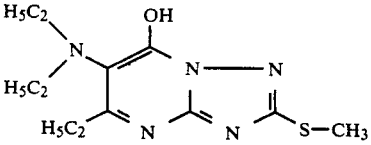
(S-57)
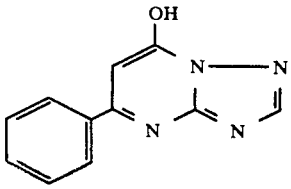
(S-58)
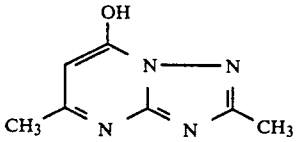
(S-59)
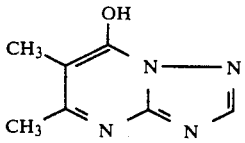

-continued (S-60)

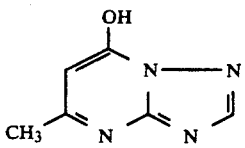

(S-61)

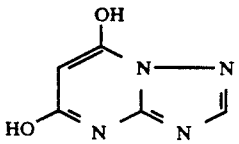

(S-62)

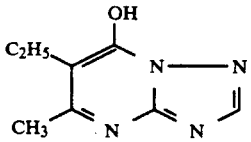

(S-63)

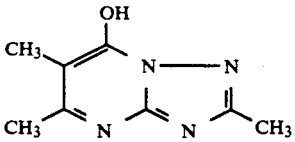

(S-64)

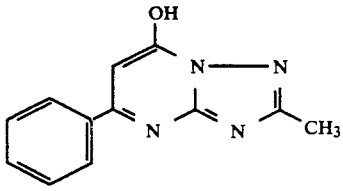

(S-65)

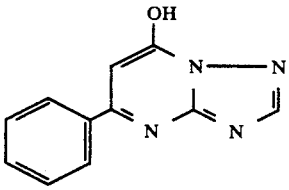

(S-66)

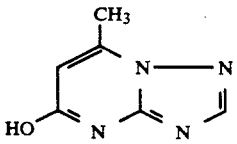

(S-67)

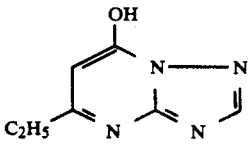

(S-68)

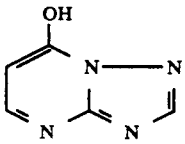

(S-69)

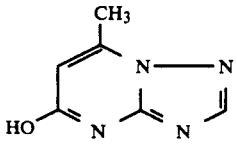

-continued (S-70)

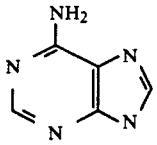

(S-71)

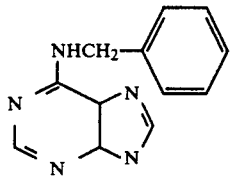

(S-72)

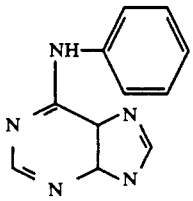

(S-73)

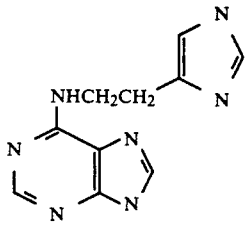

(S-74)

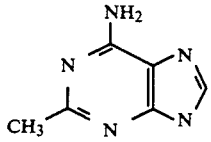

(S-75)

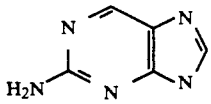

(S-76)

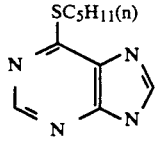

(S-77)

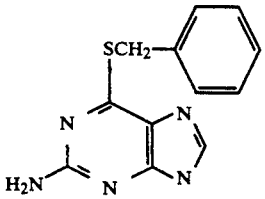

In this invention, the emulsion to be prepared with the addition of the above restrainer of this invention is of silver chloride or silver chlorobromide whose silver chloride content is not less than 90 mole %. The silver chloride or silver chlorobromide is allowed to contain other silver halide composition or other compound as long as it does not impair the effect of this invention. This invention may include such embodiment.

The emulsion layer comprising such the silver chloride or silver chlorobromide emulsion to be used in this invention will be described below:

The adding amount of the restrainer of this invention (heterocyclic mercapto compound and/or azaindene compound) to be added during the physical ripening of silver halide grains, although not restricted, is preferably $1\times10^{-5}$ to $3\times10^{-2}$ moles per mole of silver halide, and more preferably $5\times10^{-5}$ to $3\times10^{-3}$. The amount may be arbitrarily selected according to the preparing condition of silver halide grains, the average grain size of the silver halide grains, and the type of the restrainer used in this invention.

In addition, if a spectral-sensitizing dye is added at the time of the physical ripening, fogging can be restrained. The addition of the spectral-sensitizing dye should be made preferably during the silver halide grains-growing period. The addition during the grains-growing period implies that the sensitizing dye may be added either at any discretional point of time during the formation of silver halide nuclei or at any discretional point of time during the growth of silver halide nuclei; the addition at either of these points of time may be effective. Remarkable effects ca be obtained if the addition of the sensitizing dye is made at any point of time as long as it is during the grains-growing period.

The addition should be made more preferably right after the formation of nuclei.

The adding amount of the spectral-sensitizing dye to be added to silver halide emulsion at the time of the physical ripening thereof is preferably $1\times10^{-6}$ to $5\times10^{-3}$ mole per mole of silver, and more preferably $5\times10^{-6}$ to $1\times10^{-3}$ mole.

The spectral-sensitizing dye to be used may be any discretional one as long as it has a spectrally sensitizing function, and it can provide the effect of this invention.

The preferred ones as the above spectral-sensitizing dye are those compounds having the following Formula [A]:

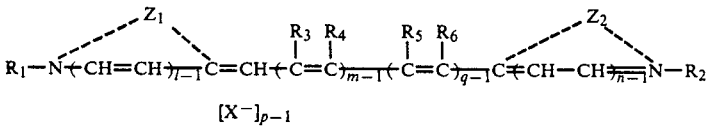

Formula [A]

wherein $Z_1$ and $Z_2$ may be either the same or different and each is a group of atoms necessary to form a heterocyclic ring; $R_2$ and $R_1$ may be either the same or different and each is an alkyl, aryl, alkenyl or aralkyl group; $R_3$ through $R_6$ each is a hydrogen atom, an alkyl, aryl, aralkyl or heterocyclic group each having not more than 4 carbon atoms; provided that the $R_2$ and $R_6$ (where q is 2) or $R_3$ and $R_5$ (where m is 2, and q is 2) may combine with each other to form a cross linkage in the form of a 5- or 6-member ring; and 1, m, n, q and p each is 1 or 2; and $X^-$is an anion.

The Formula [A] will be illustrated further in detail.

In the formula, as stated above, $Z_1$ and $Z_2$ may be either the same or different and each is a group of atoms necessary to form a heterocyclic ring, and, to be concrete, is a group of atoms necessary to form an oxazoline nucleus, oxazole nucleus, benzoxasole nucleus, naphthoxazole nucleus (such as naphtho [2,1-d)oxazole, naphtho[1,2-d]oxazole, naphthoi-2,3-d]OxaZole), thizoline nucleus, thiazole nucleus, benzothiazole nucleus, naphthothiazole nucleus (such as naphtho-[1,2-d]-thiazole, naphtho[2,1-d]thiazole, naphtho[2,3-d]thiazole), selenazoline nucleus, selenazole nucleus, benzoselenazole nucleus, naphtho selenazole necleus (such as naphtho[2,3-d)selenazole), tellurazole nucleus, benzotellurazole nucleus, naphthotellurazole nucleus (such as naphtho[2,1-d]tellurazole, naphtho [1,2-d]tellurazole), imidazole nucleus, benzimidazole nucleus, naphthoimidazole nucleus (such as napthho[1,2-d]imidazole, naphtho [2,3-d)]imidazole), pyridine nucleus, pyrrolidine nucleus, tetrazole nucleus, quinoline nucleus, or the like. Of these nucleus, the preferred ones are benzothiazole, benzimidazole and benzoxazole nuclei, and the most preferred one of them is a benzothiazole nucleus.

The above nucleus may have thereon one substituent or more various substituents.

Suitable examples of such the substituent include hydroxy group, halogen atoms (such as fluorine, chlorine, bromine), unsubstitued or substituted alkyl groups (such as methyl, ethyl, propyl, isopropyl, hydroxyethyl, carboxymethyl, ethoxycarbonylmethyl, trifluoromethyl, chloroethyl, methoxymethyl, etc.), aryl group or substituted aryl groups (such as phenyl, tolyl, anisyl, chlorophenyl, 1-naphthyl, 2-naphthyl, carboxyphenyl, etc.), heterocyclic groups (such as 2-ethyl, 2-furyl, 2-pyridyl, etc.), aralkyl groups (such as benzylphenethyl, 2-furylmethyl, etc.), alkoxy groups (such as methoxy, ethoxy, butoxy, etc.), alkylthio groups (such as methylthio, ethylthio), carboxy group, alkoxycarbonyl groups (such as methoxycarbonyl, ethoxycarbonyl, butoxycarbonyl, etc.), acylamino groups (such as acethylamino, propionylamino, benzoylamino, etc.), methylenedioxy group, tetramethylene group, cyano group, carbamoyl groups (such as dimethylcarbamoyl, methylcarbamoyl, phenylcarbamoyl, etc.), acyl groups (such as acetyl, propionyl, benzoyl, etc.), alkylsulfonyl groups (such as methylsulfonyl, ethylsulfonyl), alkylsulfinyl groups (such as methylsulfinyl, ethylsulfinyl), arylsulfonyl groups (such as phenylsulfonyl, p-tolylsulfonyl), sulfamoyl groups (such as methylsulfamoyl, ethylsulfamoyl), and the like.

The $R_1$ and $R_2$ each is an aryl, alkenyl or aralkyl group, which each may be either substituted or unsubstituted, and is preferably a sulfo-substituted alkyl group. Examples of such groups include methyl, ethyl, butyl, isopropyl, pentyl, hexyl, 2-hydroxyethyl, 3-hydroxypropyl, 2-(2-hydroxyethoxy)ethyl, 2-ethoxycarbonylmethyl, 2-sulfoethyl, 3-sulfopropyl, 3-sulfobutyl, 4-sulfobutyl, 2-hydroxy-3-sulfopropyl, 2-chloro-3-sulfopropyl, 2-(3-sulfopropyloxy)ethyl, 2-sulfatoethyl, 3-sulfatopropyl. 3-thiosulfatopropyl, 2-phosphonoethyl, 2-chloroethyl, 2,2,2-trifluoroethyl, 2,2,3,3-tetrafluoropropyl, 2-carbamoylethyl, 3-carbamoylpropyl, methoxyethyl, ethoxyethyl, methoxypropyl, allyl, phenyl, tolyl, carboxyphenyl, sulfophenyl, naphthyl. sulfonaphthyl, benzyl, phenethyl, p-sulfophenethyl, m-sulfophenethyl, p-carboxyphenethyl, and the like.

The $R_3$, $R_4$, $R_5$ and $R_6$ each is a hydrogen atom, an alkyl, aralkyl, aryl or heterocyclic group each having not more than 4 carbon atoms.

Examples of the alkyl group include methyl, ethyl, propyl, butyl and the like groups, and examples of the aralkyl group include benzyl, phenethyl, and the like groups, and examples of the aryl group include phenyl, p-tolyl and the like groups.

Examples of the heterocyclic group include aromatic heterocyclic groups such as thienyl, furyl, etc., and also those acidic heterocyclic groups having the following Formula [B]:

Formula [B]

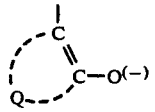

In Formula [B], Q is a group of non-metallic atoms necessary to form a 5- or 6-member heterocyclic nucleus selected from the class including, e.g., pyrazolone derivatives, isooxazolone derivatives, oxazolone derivatives, 2,4,6-triketohexahydropyrimidine derivatives, 2-thio-2,4,6-triketohexahydropyrimidine derivatives, rhodanine derivatives, 2,4-thiazolidine -one derivatives, thianaphthenone derivatives, hydantoin derivatives, indandione derivatives, oxyindole derivatives, and the like.

The $R_2$ and $R_6$ (where q is 2) or the $R_3$ and $R_5$ (where m is 2, and q is 2) may combine with each other to form an alkylene cross linkage in the form of a 5- or 6-member cyclic ring. The preferred ones of these substituents represented by the $R_3$ or $R_6$ include a hydrogen atom and an alkyl group.

The 1, m, n, q and p each is an integer of 1 or 2, and preferably q is 1, and more preferably both m and q each is 1.

The silver halide grains to be contained in the above emulsion layer are of silver chloride or silver chlorobromide whose silver chloride content is not less than 90 ? mole % (hereinafter referred to as the silver halide of this invention).

The terms 'silver chloride content is not less than 90 mole %' herein implies that the content accounts for not less than 99 mole % of the whole of the emulsion layer. For example, the silver halide composition may be used in combination with different grains (such as pure silver bromide grains), but even in this instance, the silver chloride content should be not less than 90 mole %. If the silver chloride content is lower than 90 mole % ,then it will be inferior in the aptitude to rapid processing.

The silver halide of this invention. as has been mentioned, may comprise other halide composition, but where it comprises silver iodide, the silver iodide content is preferably not more than 1 mole %, more preferably not more than 0.5 mole %, and most preferably zero. The accumulation of silver iodide in a developer solution is not acceptable because it causes inadequate desilvering in the subsequent bleaching, fixing or bleach-fix process.

The silver halide of this invention may be either of the grain in which the silver bromide-silver chloride proportion is uniform or of the core/shell structure whose internal and external are different in the silver bromide-silver chloride proportion. In the case of the core/shell structure, the grain may be either one in which the proportion varies continuously or one in which the proportion varies discontinuously.

The light-sensitive material of this invention has a single silver halide emulsion layer or a plurality of silver halide emulsion layers. The above silver halide emulsion of this invention is contained in at least one of the layers. For example, in a typical light-sensitive color photographic material, the silver halide emulsion of this invention is contained in at least one layer of the blue-sensitive silver halide emulsion layer (hereinafter called Layer B), green-sensitive silver halide emulsion layer (hereinafter called Layer G) and red-sensitive silver halide emulsion layer (hereinafter called Layer R). Where the light-sensitive material is of a multilayer structure, the silver halide composition of the light-sensitive layers other than the layer containing the silver halide of this invention, although not particularly restricted, is comprised of silver chlorobromide or silver chloride. In the case of the multilayer structure, the average of the silver chloride contents of the whole layers is preferably 90 to 100 mole %, and more preferably the silver halide content of each layer is 90 to 100 mole %.

From the rapid processing point of view, a higher silver chloride content is desirable. It is because, in the silver halide of a higher silver chloride content, the developing speed of the silver halide itself is high and the bromide ion concentration that is dissolved out to be deposited during the color developing of the silver halide is so small that the light-sensitive material is hardly subjected to the development restraining by the bromide ion.

The silver chloride content of all the silver halides of the whole color-sensitive layers (Layers B, G and R in a typical color photographic malerial) is preferably 90 to 100 mole % as mentioned above, and more preferably 95 to 100 mole %.

The terms 'silver chloride content' used in the case where all the silver chloride content of the silver halides of the whole color-sensitive layers is preferably 90 to 100 mole % does not imply that all the respective layers shall be in the preferable range, but implies that the silver chloride content of all the silver halides of the light-sensitive layer comprising the silver halide of this invention (the silver chloride content thereof is 90 to 100 mole %) and of other light-sensitive layers, if it exceeds 90 mole %, is advantageous, so that the light-sensitive material is not restricted by this.

However, it goes without saying that, in each of the color-sensitive layers its silver chloride content being all 90 to 100 mole % is most preferred, in some of the layers their silver chloride content being 95 to 100 mole % is further preferred, and in the whole color-sensitive layers their silver chloride content being 95 to 100 mole % is particularly preferred.

The emulsion layer containing the silver halide of this invention may be allowed to contain. to an extent not to impair the effect of this invention, non-invention silver halide such as less than 90 mole % silver chloride-containing silver chlorobromide, silver bromide, silver chloroiodobromide, silver iodobromide, etc., but as a whole the silver chloride content is required to be 90 to 100 mole %.

The average grain size of the silver halide grains of this invention is not particularly restricted but may be varied, and is preferably 0.2 to 1.6 μm, and more preferably 0.25 to 1.2 μm. If it is smaller than 0.2 μm, the senSitivity may sometimes be lowered, while if it exceeds 1.6 μm, the developing speed may sometimes be deteriorated.

The terms 'grain size' (r) herein, in the case of a cubic silver halide grain, is the length of a side of it, or in the case of a non-cubic-form grain, is the length of a side of a cube corresponding in the volume thereto. And each individual grain size in this sense is represented by ri, and when the actually measured total number of grains is regarded as n, then the average grain size $\bar{r}$ is expressed by the following formula:

$$\text{Average grain size } \bar{r} = \frac{\Sigma ri}{n}$$

The silver halide emulsion of this invention may be either a polydisperse emulsion in which the silver chloride grains of this invention are distributed in a wide range or a monodisperse emulsion having a narrow-size-range distribution of the grains, but the monodisperse emulsion is preferred.

The above monodisperse silver chloride grains are defined as ones the majority of which looks in the same form and is uniform in respect of the size when observed through an electron-microscopic photograph and the coefficient of variation of which is as defined by the following formula; i.e., the value obtained when the standard deviation S of the grain size distribution is divided by the average grain size $\bar{r}$ is not more than 0.15.

$$\text{Standard deviation } S = \sqrt{\frac{\Sigma (r - \bar{r}i)^2 ni}{\Sigma ni}}$$

$$\text{Coefficient of variation} = \frac{S}{\bar{r}}$$

The ri herein represents the grain size of each individual grain, and the ni represents the number of the individual grains having the grain size ri.

The amount of the silver (coated amount of silver) of the silver halide emulsion layer in the silver halide color photographic material of this invention, although not particularly restricted, is preferably 0.3 to 1 g/m$^2$ in total in the whole light-sensitive silver halide emulsion layers.

The silver halide grains of this invention may be ones obtained by being prepared in any of the processes such as the acidic process, neutral process, ammoniacal process, and the like.

Further, they may also be prepared in the manner that, for example, seed grains are first made by the acidic process, and the seed grains are then grown up to the specified size by the ammoniacal process capable of growing them fast. Alternatively, they may of course be prepared in the way that seed grains are formed by the acidic process and then grown either by the acidic process or by the neutral process.

In order to grow silver halide grains, it is desirable to pour simultaneously silver ions and halide ions in quantities meeting the growth rate of the silver halide grains as described in, e.g., Japanese Patent O.P.I. Publication No. 48521/1979 into the reaction pot therefor with the pH and pAg thereinside being controlled.

After the formation of the silver halide grains, removal of their water-soluble salts therefrom (desalting process) is usually performed.

The desalting process may be performed by any method of the prior art, such as the noodle-washing method for washing gelatin in the gelled form; the flocculation method which utilizes polyvalent anionic inorganic salts or gelatin derivatives (such as aliphatic acylated gelatin, aromatic acylated gelatin, aromatic carbamoylated gelatin, etc.); and the like.

After the desalting process, the silver halide grains are redispersed in gelatin (redissolution process).

The preparation of the silver halide of this invention is carried out as has been described above. The composition comprising the silver halide of this invention is hereinafter referred to as the silver halide emulsion of this invention.

The silver halide emulsion of this invention may be chemically sensitized by using active gelatin; sulfur sensitizers such as allylthiocarbamide, thiourea, cystine, etc.; selenium sensitizers; reduction sensitizers such as stannous salts, thiourea dioxide, polyamines, etc.; noble-metallic sensitizers such as potassium aurithiocyanate, potassium chloroaurate. 2-aurothio-3-methylbenzothiazolium chloride, etc., and sensitizers of those water-soluble salts of, e.g., ruthenium, palladium. platinum, rhodium. iridium, etc., such as ammonium chloropalladate, potassium chloroplatinate, sodium chloropalladate (some of these compounds function as sensitizers or antifogging agents according to the amount used); and the like. These sensitizers may be used alone or in arbitrary combination (such as the combined use of a gold sensitizer with a sulfur sensitizer, a gold sensitizer with a selenium sensitizer, or the like).

The silver halide emulsion of this invention is chemically ripened with the addition thereto of sulfur-containing compound and may contain at least one hydroxytetrazaindene and at least one of nitrogen-containing heterocyclic compounds having a mercapto group, the compounds being incorporated into the emulsion before, during or after the chemical ripening.

Each of the silver halide emulsion layers of this invention, in order to make it sensitive to a desired spectral wavelength region, may be optically sensitized by adding an appropriate sensitizing dye in an amount of from $5\times10^{-6}$ to $3\times10^{-3}$ moles per mole of the silver halide of this invention. As the sensitizing dye various ones may be used alone or in combination of two or more of them. Advantageously usable dyes in this invention include the following:

Sensitizing dyes usable in the blue-sensitive silver halide emulsion layer include those as described in, e.g., West German Patent No. 929,080, U.S. Pat. Nos. 2,231,658, 2,493,748, 2,503,776, 2,519,001, 2,912,329, 3,658,959, 3,672,897, 3,694,217, 4,025,349 and 4,046,572, British Patent No. 1,242,588, and Japanese Patent Examined Publication No. 14030/1969 and 24844/1977. Typical sensitizing dyes usable in the green-sensitive silver halide emulsion include those cyanine dyes, merocyanine dyes and complex cyanine dyes as described in, e.g., U.S. Pat. Nos. 1,939,201, 2,072,908, 2,739,149 and 2,945,763, British Patent No. 505,979. And typical sensitizing dyes usable in the red-sensitive silver halide emulsion include those cyanine dyes, merocyanine dyes and complex cyanine dyes as described in, e.g., U.S. Pat. Nos. 2,269,234, 2,270,378, 2,442,710, 2,454,629 and 2,776,280. In addition, those cyanine dyes, merocyanine dyes and complex cyanine dyes as described in U.S. Pat. Nos. 2,213,995, 2,493,748 and 2,519,001, and and West German Patent No. 929,080 may also be advantageously used for the green-sensitive silver halide emulsion layer or the red-sensitive silver halide emulsion layer.

These sensitizing dyes may be used either alone or in combination. The combined use of sensitizing dyes is often made for the purpose of supersensitization. Examples representative of the supersensitization are described in U.S. Pat. Nos. 2,688,545, 2,977,229, 3,397,060, 3,522,052, 3,527,641, 3,617,293, 3,628,964, 3,668,480, 3,672,898, 3,679,428, 3,703,377, 3,769,301 3,814,609, 3,837,862 and 4,026,707, British Patent Nos. 1,344,281 and 1,507,803, Japanese Patent Nos. 4936/1968 and 12375/1978, and Japanese Patent O.P.I. Publication Nos. 110618/1977 and 109925/1977.

Subsequently, the emulsion layer comprising the silver halide emulsion of this invention may contain a high-boiling solvent having a dielectric constant of not more than 6 (the may be hereinafter called the high-boiling solvent of this invention).

The high-boiling solvent of this invention may be any solvent as long as it is a compound having a dielectric constant of not more than 6. The lower limit of the dielectric constant, although not restricted, is preferably equal to or more than 1.9. For example, esters such as phthalic acid esters, phosphoric acid esters, etc., organic acid amides, ketones, hydrocarbon compounds, and the like, having a dielectric constant of not more than 6, may be used.

Also, useful high-boiling solvents in this invention are preferably high-boiling organic solvents whose vapor pressure at 100° C. is not more than 0.5 mmHg, and more preferably the phthalic acid esters and phosphoric acid esters out of the above-mentioned high-boiling organic solvents. Further, the organic solvent may be a mixture of two or more different solvents, and in this instance, the dielectric constant of the mixture needs to be not more than 6. In addition, the dielectric constant in this invention is one at 30° C. Those high-boiling solvents usable in combination in this invention include, e.g., butyl phthalate, dimethyl phthalate, tricresyl phosphate, tributyl phosphate, and the like.

The phthalic acid esters advantageously usable in this invention are those having the following Formula [HA]:

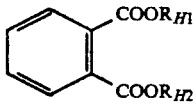

Formula [HA]

wherein $R_{H1}$ and $R_{H2}$ each is an alkyl, alkenyl or aryl group, provided that the sum of the carbon atoms of the group represented by the $R_{H1}$ or $R_{H2}$ is from 9 to 32, and more preferably from 16 to 24.

In this invention, the alkyl group represented by the $R_{H1}$ or $R_{H2}$ of the foregoing Formula [HA] is a straight-chain or branched-chain group such as, for example, a butyl, pentyl, hexyl, heptyl, octyl, nonyl, decyl, undecyl, dodecyl, tridecyl, tetradecyl, pentadecyl, hexadecyl, heptadecyl or octadecyl group. The aryl group represented by the $R_{H1}$ or $R_{H2}$ is a phenyl or naphthyl group. The alkenyl group represented by the same is a hexenyl, heptenyl or octadecenyl group. These alkyl, alkenyl and aryl groups each may have a single substituent or a plurality of substituents. The substituent to the alkyl or alkenyl group is, for example, a halogen atom, an alkoxy, aryl, aryloxy, alkenyl or alkoxycarbonyl group. The substituent to the aryl group is, for example, a halogen atom, an alkyl, alkoxy, aryl, aryloxy, alkenyl or alkoxycarbonyl group. Two or more of these substituents may be introduced to the foregoing alkyl group, alkenyl group or aryl group.

The phosphoric acid esters advantageously usable in this invention are those having the following Formula [HB]:

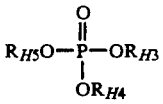

Formula [HB]

wherein $R_{H3}$, $R_{H4}$ and $R_{H5}$ each is an alkyl, alkenyl or aryl group, provided that the sum of the carbon atoms of the group represented by the $RH_{H3}$, $R_{H4}$ or $R_{H5}$ is from 24 to 54.

The alkyl group represented by the $R_{H3}$, $R_{H4}$ or $R_{H5}$ of Formula [HB] is, for example, a butyl, pentyl, hexyl, heptyl, octyl, nonyl, decyl, undecyl, dodecyl, tridecyl, tetradecyl, pentadecyl, hexadecyl, heptadecyl, octadecyl or nonadecyl group.

These alkyl, alkenyl and aryl groups each may have a single substituent or a plurality of substituents. The $R_{H3}$, $R_{H4}$ or $R_{H5}$ is preferably an alkyl group such as, e.g., a 2-ethylhexyl, n-octyl, 3,5,5-trimethylhexyl, n-nonyl, n-decyl, sec-decyl, sec-dodecyl or t-octyl group.

The following are examples of the organic solvent of this invention, but the invention is not limited to and by the examples.

Exemplified Organic Solvents:

H-1

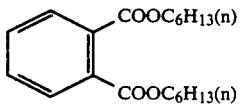

H-2

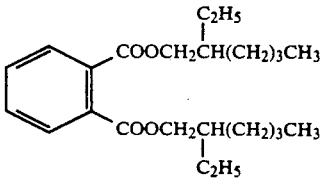

H-3

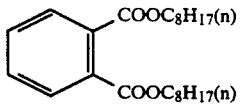

H-4

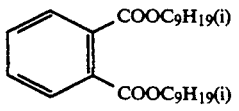

H-5

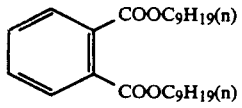

H-6

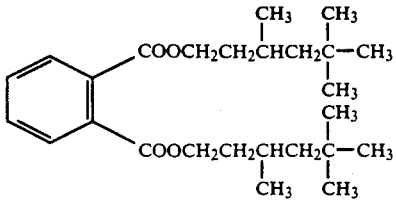

-continued

Exemplified Organic Solvents:

H-7

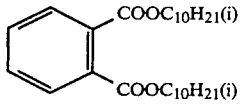

H-8

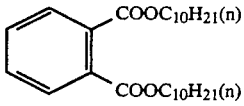

H-9

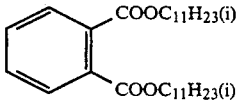

H-10

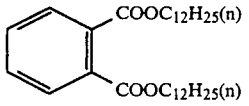

H-11

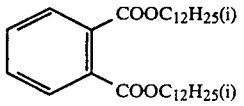

H-12

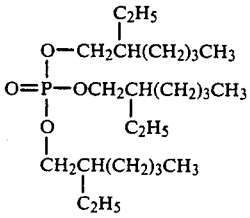

H-13

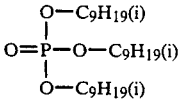

H-14

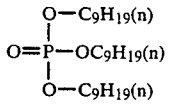

H-15

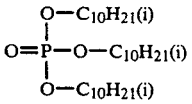

H-16

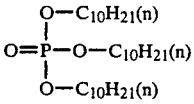

H-17

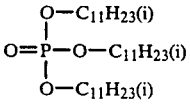

H-18

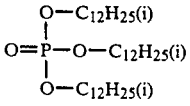

-continued

Exemplified Organic Solvents:

H-19

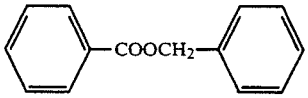

H-20

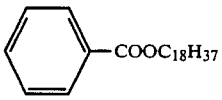

H-21

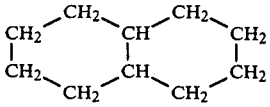

H-22

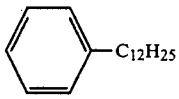

The high-boiling organic solvent of this invention may be used in the range of from 0.01 to 10 moles per mole of silver halide, and preferably from 0.05 % to 5 moles.

The incorporation of the the high-boiling organic solvent having a dielectric constant of not more than 6.0 in this invention into the silver halide emulsion of this invention may be made in the following manner: For example, at least one of the foregoing high-boiling organic solvents or at least one of the high-boiling organic solvents mixed with hydrophobic additives such as coupler, ultraviolet absorbing agent, dye image-stabilizing agent, anticolor-mixing agent, etc., and, if necessary, with a low-boiling organic solvent to dissolve these additives, is then mixed with a surface active agent-containing gelatin solution. This mixture is then emulsifiedly dispersed by using a high-speed rotary mixer, colloid mill, ultrasonic disperser, or the like, and is subsequently added to the silver halide emulsion of this invention.

As for the coupler to be incorporated into the silver halide emulsion layer of this invention with use of the above high-boiling organic solvent of this invention, any of the following compounds may be used:

Compounds suitably usable as the yellow dye-forming coupler in this invention are known acylacetanilide-type couplers. Of these couplers, benzoylacetanilide-type and pivaloylacetanilide-type compounds are advantageous.

The preferred compounds are those having the following Formula [Y];

Formula [Y]

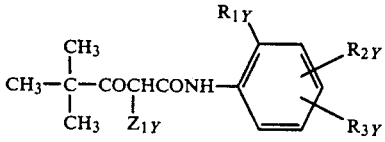

wherein $R_{1Y}$ is a halogen atom or an alkoxy group; $R_{2Y}$ is a hydrogen atom, a halogen atom or an alkoxy group which may have a substituent; $R_{3Y}$ is an acylamino, alkoxycarbonyl, alkylsulfamoyl, arylsulfamoyl, arylsulfonamido, alkylureido, arylureido, succinimido, alkoxy or arylxoy group which each may have a substituent; and $Z_{1Y}$ is a group which can be split off by the coupling reaction with the oxidized product of a color developing agent.

Usable examples of the yellow coupler include those as described in British Patent No. 1,077,874, Japanese Patent Examined Publication No. 40757/1970, Japanese Patent O.P.I. publication Nos. 1031/1972, 26133/1972, 94432/1973, 87650/-1975, 3631/1976, 115219/1977, 99433/1979, 133329/1979 and 30127/1981, U.S. Pat. Nos. 2,875,057, 3,253,924, 3,265,506, 3,408,194, 3,551,155, 3,551,156, 3,664,841, 3,725,072, 3,730,722, 3,891,445, 3,900,483, 3,929,484, 3,933,500, 3,973,968, 3,990,896, 4,012,259, 4,022,620, 4,029,508, 4,057,432, 4,106,942, 4,133,958, 4,269,936, 4,286,053, 4,304,845, 4,314,023, 4,336,327, 4,356,258, 4,386,155 and 4,401,752.

Compounds suitably usable as the magenta dye-forming coupler in this invention are known -pyrazolone-type couplers and pyrazoloazole-type couplers, and more preferably those couplers having the following Formula [$M_1$] or [$M_2$]:

Formula [$M_1$]

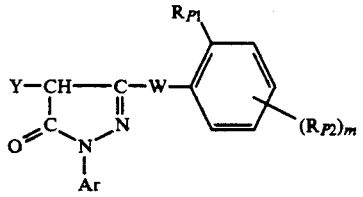

wherein Ar is an aryl group; $R_{P1}$ is a hydrogen atom or a substituent; $R_{P2}$ is a substituent; Y is a hydrogen atom or a substituent which can be split off by the reaction with the oxidized product of a color developing agent; W is —NH—, —NHCO—(wherein the N atom is bonded with the carbon atom of the pyrazolone nucleus) or —NHCONH—; and m is an integer of 1 or 2.

Formula [$M_2$]

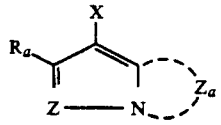

wherein Za is a group of nonmetallic atoms necessary to form a nitrogen-containing heterocyclic ring, which may have a substituent: X is a hydrogen atom or a substituent which can be split off by the reaction with the oxidized product of a color developing agent; and Ra is a hydrogen atom or a substituent.

The substituent represented by the Ra is, for example. a halogen atom, an alkyl, cycloalkyl, alkenyl, cycloalkenyl, alkinyl, aryl, heterocyclic, acyl, sulfonyl, sulfinyl, phosphonyl, carbamoyl, sulfamoyl, cyano, spiro compound residue, organic hydrocarbon compound residue, alkoxy, aryloxy, heterocyclic oxy, siloxy, acyloxy, carbamoyloxy, amino, acylamino, sulfonamido, imido, ureido, sulfamoylamino, alkoxycarbonylamino, aryloxycarbonylamino, alkoxycarbonyl, aryloxycarbonyl, alkylthio, arylthio or heterocyclic thio group.

These are described in, e.g., U.S. Pat. Nos. 2,600,788, 3,061,432, 3,062,653, 3,127,269, 3,311,476, 3,152,896, 3,419,391, 3,519,429, 3,555,318, 3,684,514, 3,888,680, 3,907,571, 3,928,044, 3,930,861, 3,930,866 and 3,933,500, Japanese Patent O.P.I. Publication Nos. 29639/1974, 111631 /1974, 129538/1974, 13041/1975, 58922/1977, 62454/1980, 118034/-1980, 38043/1981, 35858/1982 and 23855/1985, British Patent No. 1,247,493, Belgian Patent Nos. 769,116 and 792,525, West German Patent No. 2,156,111, Japanese Patent Examined Publication No. 60479/1971, Japanese Patent O.P.I. Publication Nos. 125732/1984, 228252/1984, 162548/1984, 171956/1984, 33552/1984 and 43659/1985, West German Patent No. 1,070,030, and U.S. Pat. No. 3,725,067.

Compounds usable as the cyan dye-forming coupler in this invention are known phenol-type and naphthol-type couplers. Of these the preferred couplers are those having the following Formulas [$C_1$] or [$C_2$]:

Formula [$C_1$]

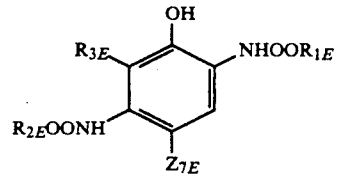

wherein $R_{1E}$ is an aryl. cycloalkyl or heterocyclic group; $R_{2E}$ is an alkyl or phenyl group; $R_{3E}$ is a hydrogen atom, a halogen atom, an alkyl or alkoxy group; $Z_{7E}$ is a hydrogen atom. a halogen atom or a group which can be split off by the reaction with the oxidized product of a color developing agent.

Formula [$C_2$]

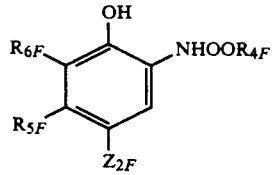

wherein $R_{4F}$ is an alkyl group (such as methyl, ethyl, propyl, butyl, nonyl); $R_{5F}$ is an alkyl group (such as methyl, ethyl); $R_{6F}$ is a hydrogen atom, a halogen atom (such as fluorine, chlorine, bromine) or an alkyl group (such as methyl, ethyl); and $Z_{2F}$ is a hydrogen atom, a halogen atom or a group which can be split off by the reaction with the oxidized product of a color developing agent.

Examples of these cyan dye-forming couplers are described in U.S. Pat. Nos. 2,306,410, 2,356,475, 2,362,598, 2,367,531, 2,369,929, 2,423,730, 2,474,293, 2,476,008, 2,498,466, 2,545,687, 2,728,660, 2,772,162, 2,895,826, 2,976,146, 3,002,836, 3,419,390, 3,446,622, 3,476,563, 3,737,316, 3,758,308 and 3,839,044, British Patent Nos. 478,991, 945,542, 1,084,480, 1,377,233, 1,388,024 and 1,543,040, and Japanese Patent O.P.I. Publication Nos. 37425/1972, 10135/1975, 25228/1975, 112038/1975, 117422/1975, 130441/1975, 6551/1976, 37647/1976, 52828/1976, 108841/1976, 109630/1978, 48237/1979, 66129/1979. 131931/1979, 32071/1980, 146050/1984, 31953/1984 and 117249/1985.

In order to incorporate these couplers into the silver halide emulsion layer of this invention, in accordance with those methods as described in, e.g., U.S. Pat. Nos. 2,322,027, 2,801,170, 2,801,171, 2,272,191 and 2,304,940, the coupler is dissolved in the high-boiling solvent of this invention, if necessary, along with a low-boiling solvent, to be dispersed in the particulate form, and then added to the emulsion. In this instance, if necessary, other additives such as hydroquinone derivative, ultraviolet absorbing agent, antidiscoloration agent, etc., may be used in combination. Also, two or more kinds of the coupler may be mixed to be used. Further, to explain in detail the preferred method of adding the coupler in this invention, one or two or more kinds of the coupler and, if necessary, other couplers, hydroquinone derivative, antidiscoloration agent, ultraviolet absorbing agent, and the like, are dissolved into the foregoing high-boiling solvent having a dielectric constant of not more than 6 (a different high-boiling solvent may be combinedly used in a quantity not to impair the effect of this invention), if necessary, in combination with a low-boiling solvent such as methyl acetate, ethyl acetate, propyl acetate, butyl acetate, butyl propionate, cyclohexanol, diethylene glycol monoacetate, nitromethane, carbon tetrachloride, chloroform cyclohexanetetrahydrofuran, amide, dioxane, methyl-ethyl ketone, or the like; this solution is then mixed with an aqueous solution containing an anionic surface active agent such as an alkylbenzenesulfonic acid or an alkylnaphthalene-sulfonic acid and/or a nonionic surface active agent such as a sorbitan-sesquioleic acid ester or sorbitan-monolauric acid ester and/or a hydrophilic binder such as gelatin; and this mixture is then emulsifiedly dispersed by a known method using a high-speed rotary mixer, colloid mill or ultrasonic disperser; and the obtained dispersed liquid is added to the silver halide emulsion of this invention.

Aside from the above, where the above coupler is to be incorporated into layers other than the silver halide emulsion layer of this invention, the coupler may be dispersed by using the latex dispersion method. The latex dispersion method and the effect thereof are described in Japanese Patent O.P.I. Publication Nos. 74538/1974, 59943/1976 and 32552/1979, and Research Disclosure Oct. 1976, No. 14850, pp.77–79.

Suitable examples of the latex to be used in the latex dispersion method include those homopolymers, copolymers and terpolymers of monomers such as, e.g., styrene, acrylates such as n-butyl acrylate, n-butyl methacrylate, 2-acetacetoxyethyl methacrylate, 2-(methacryloyloxy)-ethyltrix:ethyl-ammonium methosulfate, sodium 3-(methacryloyloxy)-propane-1-sulfonate, N-isopropylacrylamide, N-[2-(2-methyl-4-oxopentyl)] acrylamide, 2-aCrylamido-2-methylpropanesulfonic acid, and the like.

Where an alkali-soluble coupler is incorporated into an emulsion layer other than the emulsion layer of this invention, the coupler may be added in the form of an alkaline solution.

The silver halide color photographic material of this invention may contain in the hydrophilic colloid layer thereof a water-soluble dye as a filter dye or antiirradiation dye or for various other purposes. Examples of such the dye include oxonol dyes, hemioxonol dyes, merocyanine dyes and azo dyes. Above all, the oxonol dyes, hemioxonol dyes and merocyanine dyes are particularly useful. Examples of the dyes usable in this invention are described in British Patent Nos. 584,609 and 1,277,429, Japanese Patent O.P.I. Publication Nos. 85130/-1973, 99620/1974, 114420/1974, 129537/1974, 108115 /1977 and 25845/1984, U.S. Pat. Nos. 2,274,782, 2,533,472, 2,958,879, 3,125,448, 3,148,187, 3,177,078, 3,247,127, 3,540,887, 3,575,704, 3,653,905, 3,718,472, 4,071,312 and 4,070,352. The silver halide color photographic material of this invention may contain various photographic additives such as antifoggant, stabilizer, ultraviolet absorbing agent, anticolorstain agent, brightening agent, antidiscoloration agent, antistatic agent, hardening agent, surface active agent, plasticizer, wetting agent, and the like. (Reference can be made to Research Disclosure No. 17643.)

In the silver halide color photographic material of this invention, examples of the hydrophilic colloid to be used for the preparation of the silver halide emulsion of this invention include discretional materials; for example, proteins such as gelatin, derivative gelatin, graft polymers of gelatin with other high-molecular materials, albumin, casein, etc.; cellulose derivatives such as hydroxyethyl cellulose derivatives, carboxymethyl cellulose, etc.; starch derivatives; synthetic hydrophilic high-molecular materials such as homopolymers or copolymers of polyvinyl alcohol, polyvinylimidazole, polyacrylamide, etc.; and the like.

Materials for the support of the silver halide color photographic material of this invention may be any of the so-called reflective-type support materials, such as baryta paper, polyethylene-laminated paper, polypropylene synthetic paper, reflective layer-coated or reflective sheet-combined transparent support such as glass plates, cellulose acetate, cellulose nitrate, polyester film such as of polyethylene terephthalate, polyamide film, polycarbonate film, polystyrene film, and the like. These support materials may be arbitrarily selected to be used according to the purpose for which the photographic material is used.

For the coating of the emulsion layer and other constituent layers in this invention various coating methods may be used which include the dipping coating, air-doctor coating, curtain coating, hopper coating and the like. And the simultaneous coating method capable of coating two or more layers simultaneously as described in U.S. Pat. Nos. 2,781,791 and 2,941,898 may also be used.

In this invention, the coating order of the respective emulsion layers may be arbitrarily settled. For example, in the case of a full-color photographic paper material, it is desirable to arrange in order from the support side a blue-sensitive silver halide emulsion layer, a green-sensitive silver halide emulsion layer, and then a red-sensitive silver halide emulsion layer.

In the light-sensitive material of this invention, an appropriate thickness-having intermediate layer may be discretionally provided according to purposes, and in addition, various constituent layers may be combinedly provided which include filter layer, anticurling layer, protective layer, antihalation layer, and the like. As the binder for these constituent layers any of the same hydrophilic colloid materials as usable in the emulsion layer may be used, and in these layers the same various photographic additives as those mentioned in the above emulsion layer may be used.

The processing method of the silver halide color photographic material of this invention is not particularly restricted: all sorts of processing methods may be used. For example, typical methods are: a method in which color developing, bleach-fix, and, if necessay, washing and/or stabilizing are performed; a method in which, after color developing, bleaching and fixing are separately performed, and, if necessary, washing and/or stabilizing are then performed; a method in which prehardening, neutralizing, color developing, stopfix, washing, bleaching, fixing, washing, post-hardening and then washing are performed in the order; a method in which color developing, washing, supplementary color developing, stopping, bleaching, fixing, washing and then stabilizing take place in the order; a developing method in which the developed silver produced by color developing, after being subjected to halogenation bleaching, is color-developed again to increase the amount of the formed dye; and the like. Any of these methods can be used, but the silver halide color photographic material of this invention is suited to rapid processing by the processes of color developing, bleach-fix and washing (or stabilizing).

The color developer solution for use in developing the silver halide color photographic material of this invention is an aqueous alkaline solution containing a color developing agent and having a pH of preferably not less than 8, and more preferably from 9 to 12. The color developing agent is an aromatic primary amine color developing agent which is a compound having a primary amino group on its aromatic ring and capable of developing the exposed silver halide. Further, if necessary, a precursor to form such a compound may be added to the color developer solution.

Typical ones as the above color developing agent are p-phenylenediamine-type compounds. Useful examples of the agent include 4-amino-N,N-diethylaniline, 3-methyl-4-amino- N,N-diethylaniline, 4-amino-N-ethyl-N-β-hydroxyethylaniline, 3-methyl-4-amino-N-β-hydroxyethylaniline, 3-methyl -4-amino-N-ethyl-N-β-methoxyethylaniline, 3-methyl-4-amino-N-ethyl-N-β-methanesulfonamidoethylaniline, 4-hydroxyethylaniline, 3-methoxy-4-amino-N-ethyl-N -β-methoxyethylaniline, 3-acetamido-4-amino -N,N-dimethylaniline, N-ethyl-N-β-[β-(β-methoxyethoxy) -ethoxyethyl-3-methyl-4-aminoaniline, N-ethyl-N-β-(β-methoxy)-ethyl-3-methyl-4-aminoaniline, and salts of these compounds (such as sulfates, hydrochlorides, sulfites, p-toluenesulfonates, and the like).

In addition, those compounds as described in, e.g., Japanese Patent O.P.I. Publication Nos. 64932/1973, 131526/-1975 and 95849/1976, and Bent et al, the Journal of the 'American Chemical Society', pp.3100-3125 (1951) also are typical compounds.

The using amount of these aromatic primary amine compounds depends on to what degree the activity of a developer should be settled, but in order to raise the activity it is desirable to increase the using amount. The using amount range is from 0.0002 mole to 0.7 mole per liter of the developer solution. According to purposes, two or more kinds of such the compound may be used in arbitrary combination; for example, 3-methyl-4-amino-N,N-diethylaniline and 3-methyl-4-amino-N-ethyl-N-β-methanesulfonamidoethylaniline, 3-methyl -4-amino-N-ethyl-N-β-methanesulfonamidoethylaniline and 3-methyl-4-amino-N-ethyl-N-β-hydroxyethylaniline, and the like combination.

The foregoing color developer solution may, if necessary, contain an oxidation inhibitor such as N.N-diethylhydroxyamine, tetronic acid, tetronimide, 2-anilinoethanol dihydroxyacetone aromatic secondary alcohol, hydroxamic acid, pentose or hexose. pyrogallol-1,3-dimethyl-ether, or the like.

The color developer solution may further discretionarily contain various components which are usually added to ordinary developer solutions, including alkaline agents such as, e.g., sodium hydroxide, sodium carbonate, etc., alkali-metallic sulfites, alkali-metallic hydrogensulfites, alkali-metallic thiocyanates, alkali-metallic chlorides, benzyl alcohol, water softener, thickening agent, development accelerator, and the like.

It is desirable, however, that the above benzyl alcohol be not added to the color developer solution: The reason is that benzyl alcohol has a high pollution load such as BOD or COD and is so poor in its hydrophilicity that, when used in a developer solution, it needs to be used in combination with other solvent such as diethylene glycol or triethylene glycol, but since glycols are also high in BOD or COD, if they are used, the overflowed part of the developer solution will cause an environmental pollution problem. Besides, benzyl alcohol is less soluble in a developer solution, so it takes time to prepare a developer solution or a replenisher, thus being disadvantageous in respect of the work efficiency. Also, if the replenishing amount is large, the number of replenishing time increases to burden the processing operation.

Accordingly, the use of a color developer solution substantially not containing benzyl alcohol contributes to the solution to the environmental pollution problem as well as to the work problem.

Aside from the above additives, other additives which may be added to the above color developer solution include compounds for rapid processing such as, e.g. adenine, nitrobenzimidazole, mercaptobenzimidazole, 5-methyl-benzotriazole, agents, preservatives, interlayer-effect accelerators, chelating agents, and the like.

Generally known compounds as the bleaching agent to be used in a bleacher solution or a bleach-fix bath in the bleaching process include those in which a metallic ion such as of iron, cobalt, copper, etc. is coordinated with organic acids such as aminopolycarboxylic acids, oxalic acid, citric acid, etc. Typical examples of the above-mentioned aminopolycarboxylic acid are as follows:

Ethylenediaminetetraacetic acid
Diethylenediaminepentaacetic acid
Propylenediaminetetraacetic acid
Nitrilotriacetic acid
Iminodiacetic acid
Ethyl-ether-diaminetetraacetic acid
Ethylenediaminetetrapropionic acid
Disodium ethylenediaminetetraacetate
Pentasodium diethylenetriaminepentaacetate
Sodium nitrilotriacetate The bleacher solution may contain various additives in addition to the above bleaching agent. Where a bleach-fix bath is used in the bleaching process, a composition comprising a silver halide fixing agent in addition to the above bleaching agent is used. The bleach-fix bath may also contain a halogen compound such as potassium chloride. And similarly to the foregoing bleacher solution, the bath may also contain various other additives such as, e.g., pH buffer, brightening agent, defoaming agent, surface active agent, preservative, chelating agent, stabilizer, organic solvent, and the like.

Examples of the above silver halide fixing agent include those compounds usually used in ordinary fixer solutions, which react with silver halide to form a water-soluble silver salt, such as, e.g., sodium thiosulfate, ammonium thiosulfate, potassium thiocyanate, sodium thiocyanate, thiourea, thioether and the like.

The processing temperature applied to the respective processing steps such as the color developing, bleach-fix (or bleachin and fixing) and, if necessary, washing and stabilizing, and the final drying of the silver halide color photographic material of this invention is desirable to be not less than 30° C.

The silver halide color photographic material of this invention may be stabilized instead of being washed by the application of any of those stabilization methods as described in Japanese Patent O.P.I. Publication Nos.

14834/1953, 105145/-1983, 134634/1983 and 18631/1983, and Japanese Patent Application Nos. 2709/1983 and 89288/1984.

EXAMPLES

The following are examples of this invention. It goes without saying that the invention is not limited by the examples.

Prior to the following examples, preparation examples of those emulsions to be used in the following examples will be first described below:

Preparation Examples

The preparation of the seed emulsions to be used in common in the following preparation examples will be given.

Three seed emulsions NE-1 to NE-3 as shown in Table 1 were prepared in accordance with the method described in Japanese Patent O.P.I. Publication No. 45437/1975.

Each seed emulsion contains silver halide in an amount of 1.413 moles per liter.

TABLE 1

| Seed EM No. | AgBr/AgCl mol ratio | Average grain size (μm) | Crystal habit | Preparation method |
|---|---|---|---|---|
| NE-1 | 0/100 | 0.15 | Cubic | Acid method |
| NE-2 | 15/85 | 0.15 | Cubic | Acid method |
| NE-3 | 5/95 | 0.15 | Cubic | Acid method |

Preparation Example 1

| | |
|---|---|
| Solution A: | |
| Osein gelatin | 54.4 g |
| Sodium polyisopropylene-polyethyleneoxy-succinate, 10% ethanol solution | 6.0 ml |
| Seed emulsion NE-1 | 264.0 ml |
| Distilled water | 5736.0 ml |
| Solution B: | |
| NaCl | 390.7 g |
| 0.2% methanol solution of Exemplified Compound (S-40) | 400.0 ml |
| Distilled water to make 2,230 ml. | |
| Solution C: | |
| Silver nitrate | 1137.0 g |
| 10% $HNO_3$ | 124.0 ml |
| Distilled water to make 2,230 ml. | |

Solution A was put in a mechanical stirrer-equipped reaction pot, and the pH and the pAg of the solution were adjusted to 2.0 and 7.3, respectively, at 40° C.

To Solution A, with stirring in the reaction pot, were added Solutions B and C by the double-jet method, spending the minimum time producing no small grains. The pAg inside the reaction pot was kept at 7.3.

The reaction product was desalted in accordance with the usual flocculation method, and after that gelatin was added to make redispersion.

The thus obtained emulsion was regarded as Em-1. As a result of the electron-microscopic observation, it was a monodisperse emulsion having a coefficient of variation of not more than 0.15. The average grain size of the grains was 0.4 μm and the grain was in the cubic form.

(Preparation Example 2)

The foregoing Preparation Example 1 was repeated in the same manner except that the Exemplified Compound (S-40) was replaced by Exemplified Compounds (S-5), (S-6), (S-32) and (S-70).

These obtained emulsions each was of grains in the cubic form, whose average grain size was 0.4 μm. These emulsions were regarded as EM-2, Em-3, Em-4 and Em-5, respectively.

(Preparation Example 3)

The following solutions were prepared:

| | |
|---|---|
| Solution A: | |
| Osein gelatin | 54.4 g |
| Sodium polyisopropylene-polyethyleneoxy-disuccinate, 10% ethanol solution | 6.0 ml |
| Seed emulsion NE-1 | 264.0 ml |
| Distilled water | 5736.0 ml |
| Solution B: | |
| NaCl | 390.7 g |
| Distilled water to make 2,230 ml. | |
| Solution C: | |
| Silver nitrate | 1137.0 g |
| 10% $NHO_3$ | 124.0 ml |
| Distilled water to make 2,230 ml. | |
| Solution D: | |
| 0.2% methanol solution of Exemplified Compound (S-42) | 400.0 ml |

In similar manner to that in Preparation Example 1, Solution A was put in a reaction pot and the pH and pAg of the solution were adjusted to 2.0 and 7.3, respectively, at 60° C. To Solution A, with stirring in the reaction pot, were added Solutons B and C by the double-jet method, spending the minimum time producing no small grains. During this period the pAg was kept at 7.3. In addition. simultaneously with the commencement of the addition of Solutions B and C, Solution D was added at a speed in proportion to the adding speed of Solutions B and C.

To the grains obtained in this manner, after being desalted by the usual flocculation method, was added gelatin to make redispersion.

The obtained emulsion was of grains in the cubic form, whose average grain size was 0.4 μm. This emulsion was regarded as Em-6.

Preparation Example 4

Preparation Example 3 was repeated in the same manner except that the Exemplified Compound (S-42) in Preparation Example 3 was replaced by Exemplified Compound (S-5). The obtained emulsion was of grains in the cubic form, whose average grain size was 0.4 μm. This was regarded as Em-7.

Preparation Example 5

Emulsions were prepared in quite the same manner as in Preparation Example 3 except that the adding position of Solution D was varied.

Preparation Example 5-1

The addition of solution D was started simultaneously with the commencement of the addition of Solutions B and C, and when 50% by weight of Solutions B and C was added, the addition of Solution D was completed. Solution D was added at such a speed as to complete the addition of the whole solution by the time. The obtained emulsion was regarded as Em-8.

Preparation Example 5-2

The addition of Solution D was started when 50% by weight of Solutions B and C was added, and was completed simultaneously with the completion of the addition of Solutions B and C. Solution D was added at such a speed as to complete the addition of the whole solution by the time. The obtained emulsion was regarded as Em-9.

Preparation Example 5-3

The whole quantity of Solution D was added at once when 50% by weight of Solutions B and C was added. The obtained emulsion was regarded as Em-10.

Preparation Example 5-4

Preparation of Comparative Emulsion

After completion of the addition of Solutions B and C, the whole quantity of Solution D was added. The obtained emulsion was regarded as Em-11.

The emulsiOnS (Em-8 to Em-11) were all of grains in the cubic form, whose average grain size was 0.4 μm. (Preparation Example 6)

An emulsion was prepared in quite the same manner as in Preparation Example 1 except that Seed Emulsion NE-2 was used in place of the NE-1 and the following Solution E was used in place of the Solution B in Preparation Example 1.

| Solution E: | |
|---|---|
| NaCl | 379.0 g |
| KBr | 23.9 g |
| 0.2% methanol solution of Exemplified Compound (S-42) | 400.0 ml |
| Distilled water to make 2,230 ml. | |

The obtained emulsion was of grains in the cubic form, whose average grain size was 0.4 μm. This emulsion was regarded as Em-12.

Preparation Example 7

The manner of Preparation Example 6 was repeated using Exmplified Compounds (S-5), (S-6), (S-32) and (S-70) in place of the Exemplified Compound (S-42) to thereby prepare four emulsions. The obtained emulsions were of grains in the cubic form, whose average grain size was 0.4 μm. These emulsions were regarded as Em-13, Em-14, Em-15 and Em-16, respectively.

Preparation Example 8

An emulsion was prepared in quite the same manner as in Preparation Example 1 except that the pH inside the reaction pot was adjusted to 5.85.

The obtained emulsion was of grains in the cubic form, whose average grain size was 0.4 μm. This emulsion was regarded as Em-17.

Preparation Example 9

Preparation of Comparative Emulsion

An emulsion was prepared in quite the same manner as in Preparation Example 1 except that the Seed Emulsion NE-1 was replaced by Seed Emulsion NE-3 and the Solution B was replaced by the following Solution F.

| Solution F: | |
|---|---|
| NaCl | 332.0 g |
| KBr | 119.0 g |
| 0.2% methanol solution of Exemplified Compound (S-42) | 400.0 ml |
| Distilled water to make 2,230 ml. | |

The obtained emulsion was of grains in the cubic form, whose average grain size was 0.4 μm. This emulsion was regarded as Em-18.

Preparation Example 10

Preparation of Comparative Emulsions

Emulsions were prepared in quite the same manners as in Preparation Examples 1, 6 and 10 except that the Exemplified Compound (S-42) in these Preparation Examples was not added at all. The obtained emulsions were of grains in the cubic form, whose average grain size was 0.4 μm. These emulsions were regarded as Em-19, Em-20 and Em-21, respectively.

The above-prepared Emulsions Em-1 through Em-21 are monodisperse emulsions, whose coefficient of variation is not more than 0.15.

TABLE 2

(Summary of the results)

| Em No. | Silver halide composition AgCl content (mole %) | Invention's restrainer added in grain formation | Adding position*1 | pH in grain formation | Remarks |
|---|---|---|---|---|---|
| 1 | 100 | (S-42) | In grain formation | 2.0 | Invention |
| 2 | 100 | (S-5) | In grain formation | 2.0 | Invention |
| 3 | 100 | (S-6) | In grain formation | 2.0 | Invention |
| 4 | 100 | (S-32) | In grain formation | 2.0 | Invention |
| 5 | 100 | (S-70) | In grain formation | 2.0 | Invention |
| 6 | 100 | (S-42) | Sepately added in grain formation | 2.0 | Invention |
| 7 | 100 | (S-5) | Separately added in grain formation | 2.0 | Invention |
| 8 | 100 | (S-42) | 0 to 50*2 (% by wt) | 2.0 | Invention |
| 9 | 100 | (S-42) | 50 to 100*3 (% by wt) | 2.0 | Invention |
| 10 | 100 | (S-42) | All added at once at the time of 50% by wt | 2.0 | Invention |
| 11 | 100 | (S-42) | Immediately after grain formation | 2.0 | Comparative |
| 12 | 97 | (S-42) | In grain formation | 2.0 | Invention |
| 13 | 97 | (S-97) | In grain formation | 2.0 | Invention |
| 14 | 97 | (S-6) | In grain formation | 2.0 | Invention |
| 15 | 97 | (S-32) | In grain formation | 2.0 | Invention |

TABLE 2-continued (Summary of the results)

| Em No. | Silver halide composition AgCl content (mole %) | Invention's restrainer added in grain formation | Adding position*1 | pH in grain formation | Remarks |
|---|---|---|---|---|---|
| 16 | 97 | (S-70) | In grain formation | 2.0 | Invention |
| 17 | 100 | (S-42) | In grain formation | 5.85 | Invention |
| 18 | 85 | (S-42) | In grain formation | 2.0 | Comparative |
| 19 | 100 | — | — | 2.0 | Comparative |
| 20 | 97 | — | — | 2.0 | Comparative |
| 21 | 85 | — | — | 2.0 | Comparative |

Note:
*1Adding position: For detail, see the foregoing Preparation Examples.
*20 to 50 (% by wt): Added from the beginning up to the time when the added amount of the silver salt solution reached 50% by weight.
*350 to 100 (% by wt): Addition was made starting from the time of 50% by weight of until completion of the addition of all the silver salt solution.

EXAMPLE 1

On a polyethylene-laminated paper support were coated the following layers in order from the support side, whereby silver halide color photographic materials Samples No. 101 to No. 112 were prepared.

| | |
|---|---|
| Layer 1: | |
| Gelatin | 1.20 g/m$^2$ |
| A silver halide emulsion comprising the emulsion prepared in the foregoing Preparation Examples (types of the emulsion are given in Table 3) which is ripened for 100 minutes at 50° C. with gold-sulfur sensitization treatment by the addition thereto of the optimum amounts of sodium thiosulfate and chloroauric acid and to which are then added $3.0 \times 10^{-4}$ mole/ml Ag of a methanol solution of a spectrally sensitizing dye (the following Compound (X)) and further $1.0 \times 10^{-3}$ mole/ml Ag of an aqueous solution of Compound (A) having the following structural formula. | 0.30 g/m$^2$ (silver equivalent) |
| High-boiling solvent (types of the solvent are shown in Table 3). | 0.50 g/m$^2$ |
| Coupler (Y-1) | 0.80 g/m$^2$ |
| Layer 2: | |
| Gelatin | 0.50 g/m$^2$ |
| Sodium 2,4-dichloro-6-hydroxy-S-triazine(hardener) | 0.017 g/g of the gelatin |

Compound (A)

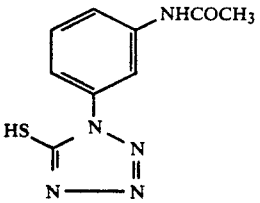

(Y-1)

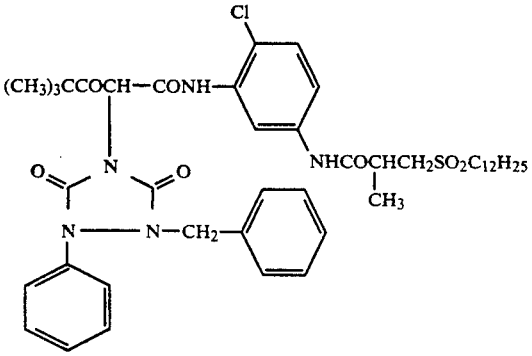

-continued

Sensitizing Dye X

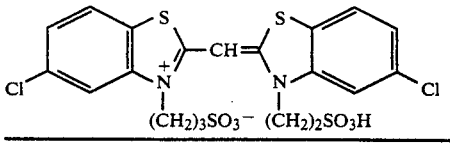

These obtained light-sensitive material Samples No. 101 to No. 112 were each exposed through an optical wedge, and then processed according to the following processing steps:

| Processing Step | Temperature | Time |
|---|---|---|
| (1) Color developing | 35° C. | 45 or 105 seconds* |
| (2) Bleach-fix | 35° C. | 45 seconds |
| (3) Stabilizing | 30° C.-34° C. | 90 seconds |
| (4) Drying | 60° C.-90° C. | 90 seconds |

Note:
*Samples Nos. 101, 102, 104, 105, 107, 108, 110 and 111 were developed for 45 seconds, while Nos. 103, 106, 109 and 112 were developed for 105 seconds.

The compositions of the respective processing solutions which were used in the above steps are as follows:

| Color Developer Solution: | |
|---|---|
| Pure water | 800 ml |
| Ethylene glycol | 10.0 ml |
| N,N-diethylhydroxyamine | 12.0 ml |
| Potassium chloride | 2.0 g |
| Potassium sulfite | 0.2 g |
| N-ethyl-N-β-methanesulfonamidoethyl-3-methyl-4-aminoaniline sulfate | 5.0 g |
| Sodium tetrapolyphosphate | 2.0 g |
| Potassium carbonate | 30.0 g |
| Pure water to make 1 liter. Use 20% potassium hydroxide or 10% dilute sulfuric acid to adjust the pH to 10.08. | |

| Bleach-Fix Bath: | |
|---|---|
| Pure water | 800 ml |
| Iron(III)-ammonium ethylenediaminetetraacetate | 65.0 g |
| Disodium ethylenediaminetetraacetate | 5.0 g |
| Ammonium thiosulfate | 85.0 g |
| Sodium hydrogensulfite | 10.0 g |
| Sodium metabisulfite | 2.0 g |
| Sodium chloride | 10.0 g |
| Pure water to make 1 liter. Use dilute sulfuric acid to adjust the pH to 6.2. | |

| Stabilizer solution: | |
|---|---|
| 5-Chloro-2-methyl-4-isothiazoline-3-one | 1.0 g |

-continued

| | |
|---|---|
| 1-Hydroxyethylidene-1,1-disulfonic acid | 2.0 g |
| Water to make 1 liter. Use sulfuric acid or potassium hydroxide to adjust the pH to 7.0. | |

Each of the obtained samples was divided into two parts, one part was subjected to sensitometric tests in usual manner, and the other part, after being processed, was allowed to stand over a period of 20 days under the sunlight to evaluate its dye image's resistance to light. The obtained results are as given in Table 3, wherein the 'fog' is a minimum density, the 'sensitivity (S)' is a reciprocal of exposure giving a density of fog plus 0.3, and the gamma (γ) represents a gradation, i.e., the inclination of a sensitometric curve between the points of densities 0.3 and 0.8.

TABLE 3

| | Composition of sample | | | | | |
|---|---|---|---|---|---|---|
| Sample No. | Emulsion used | Invention's restrainer added in grain formation | High-boiling solvent | Fog | γ*1 | Resistance*2 to light (%) |
| 101 (Inv.) | Em-1 | (S-42) | H-6*4 (4.6) | 0.04 | 3.48 | 77 |
| 102 (Inv.) | Em-12 | (S-42) | H-6 | 0.03 | 3.52 | 75 |
| 103 (Comp.) | Em-18 | (S-42) | H-6 | 0.04 | 3.50 | 76 |
| 104 (Comp.) | Em-19 | (—) | H-6 | 0.17 | 2.55 | 76 |
| 105 (Comp.) | Em-20 | (—) | H-6 | 0.18 | 2.59 | 75 |
| 106 (Comp.) | Em-21 | (—) | H-6 | 0.16 | 2.65 | 77 |
| 107 (Comp.) | Em-1 | (S-42) | DBP*3 (6.4) | 0.10 | 3.62 | 56 |
| 108 (Comp.) | Em-12 | (S-42) | DBP | 0.09 | 3.58 | 55 |
| 109 (Comp.) | Em-18 | (S-42) | DBP | 0.10 | 3.60 | 55 |
| 110 (Comp.) | Em-19 | (—) | DBP | 0.18 | 3.45 | 56 |
| 111 (Comp.) | Em-20 | (—) | DBP | 0.18 | 3.50 | 55 |
| 112 (Comp.) | Em-21 | (—) | DBP | 0.17 | 3.50 | 55 |

Note:
*1γ: It represents the inclination of a sensitometric curve between the points of densities 0.8 and 1.8.
*2Resistance to light: Percentage of the density obtained after the initial density 1.0 is exposed to the sunlight for 20 days.
*3DBP: Dibutyl phthalate.
*4Figure in ( ) shows dielectric constant of the solvent.

Samples 103, 106, 109 and 112, which used Emulsions Em-18 and Em-21 whose silver chloride content was less than 90 mole %, were not able to give adequate densities in the 45-second color development; they required 105-second color development, whereas Samples 101, 102, 104, 105, 107, 108, 110 and 111, which used Emulsions Em-1, 12, 19 and 20 whose silver chloride content was more than 90 mole %, gave adequate densities even in the 45-second color development. From the above results it is understood that the samples using these silver halide emulsions whose silver chloride content is more than 90 mole % are capable of being processed rapidly.

It is also understood, however, that Samples 104, 105, 110 and 111, which use Emulsions Em-1, 9 and 20 containing more than 90 mole % silver chloride but having no restrainers of this invention added thereto at the time of the silver halide grain formation, have the problem that their fog densities are extremely high. Also, it is apparent that, by comparison of Samples 104 and 105 containing the high-boiling solvent of this invention with Samples 110 and 111 containing the non-invention high-boiling solvent, they are almost the same in the fog density but the former samples, although highly excellent in their dye image's resistance to light, show low (soft) gradations. On the other hand, the samples comprising the non-invention high-boiling solvent are conspicuously inferior in the resistance to light to the samples comprising the high-boiling solvent of this invention, so that the former is unacceptable for practical use (comparison between Samples 101-106 and Samples 107-112). Thus, there is the problem that mere combination of a high-silver-chloride content emulsion with the high-boiling solvent of this invention aimed at satisfying both the light resistance and aptitude to rapid processing, although it may improve the resistance to light, not only increases the fog density but also lowers the gradation. In contrast, where the emulsions of this invention (Em-1 and 12) are used, they show remarkable improvement on the fog density even in combination with the non-invention high-boiling solvent, and, in combination with the high-boiling solvent of this invention, further reduces the fog density (comparison of Samples 107 and 108 with Samples 101 and 102), and in addition they show little or no such lowering of the gradation as seen in the combination of the non-invention high-silver-chloride-content emulsion with the high-boiling solvent of this invention (comparison of Samples 101 and 102 with Samples 104 and 105).

From the results above mentioned it is apparent that the emulsion of this invention, even though it is a high-silver-chloride-content emulsion, produces a low fog density, and the low fog density can be further reduced by the combination with the high-boiling solvent of this invention without deteriorating the gradation. Thus, the samples for this invention are excellent in the aptitude to rapid processing as well as in the dye image's resistance to light, reduce the fog density remarkably and show contrasty gradation.

EXAMPLE 2

On a polyethylene-laminated paper support were coated the following layers in order from the support side, whereby silver halide color photographic material Samples 201 to 207 were prepared.

| | |
|---|---|
| Layer 1: | |
| Gelatin | 1.20 g/m$^2$ |
| A silver halide emulsion comprising the emulsion prepared in the foregoing Preparation Examples (types of the emulsion are shown in Table 4) which is the ripened for 100 minutes at 50° C. with sulfur sensitization treatment by the addition thereto of the optimum amount of sodium thiosulfate and to which are then added 3.0 × 10$^{-4}$ mole/ml Ag of a | 0.30 g/m$^2$ (silver equivalent) |

-continued

| | |
|---|---|
| methanol solution of a spectrally sensitizing dye (the following Compound (Y)) and further $1.0 \times 10^{-3}$ mole/ml Ag of an aqueous solution of Compound (B) having the following structural formula. | |
| High-boiling solvent (types of the solvent are shown in Table 4) | 0.50 g/m$^2$ |
| Coupler (M-1) | 0.80 g/m$^2$ |
| Layer 2: | |
| Gelatin | 0.50 g/m$^2$ |
| Sodium 2,4-dichloro-6-hydroxy-S-triazine(hardener) | 0.017 g/g of the gelatin |

Compound B

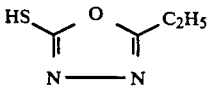

(M-1)

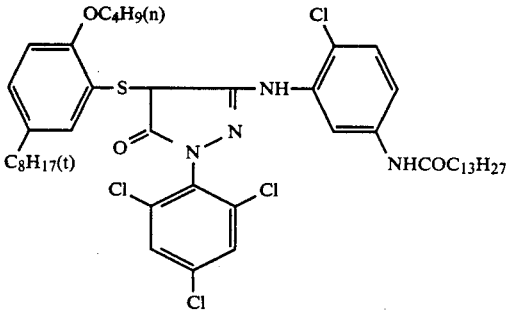

Sensitizing Dye Y

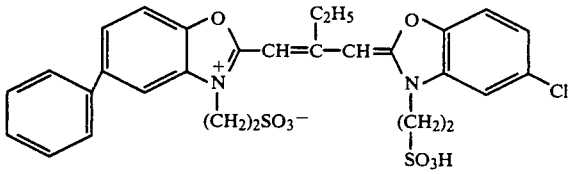

each of these obtained samples was exposed and processed in similar manner to Example 1, provided that the color developing took place for 45 seconds only because adequate color densities were obtained in this processing time.

The obtained sensitomertric results are shown in Table 4.

TABLE 4

| | Composition of sample | | | | |
|---|---|---|---|---|---|
| Sample No. | Emulsion used | Invention's restrainer added in grain formation | High-boiling solvent used | Fog | γ |
| 201 (Inv.) | Em-1 | (S-42) | H-6 | 0.04 | 3.48 |
| 202 (Inv.) | Em-6 | (S-42) | H-6 | 0.03 | 3.45 |
| 203 (Inv.) | Em-8 | (S-42) | H-6 | 0.03 | 3.44 |
| 204 (Inv.) | Em-9 | (S-42) | H-6 | 0.04 | 3.52 |
| 205 (Inv.) | Em-10 | (S-42) | H-6 | 0.04 | 3.50 |
| 206 (Comp.) | Em-11 | (S-42) | H-6 | 0.17 | 2.57 |
| 207 (Comp.) | Em-19 | (—) | H-6 | 0.17 | 2.55 |

This example shows the difference in the effect obtained when varying the adding manner or the adding position of the restrainer of this invention to be added in the formation of grains.

By comparison between Emulsions Em-1 and Em-2, in which the adding manner of the azaindene compound was varied as mentioned above (comparison between Samples 201 and 202), they show little or no difference in the fog density and gradation. Also, by comparison between Emulsions Em-1, 8, 9, 10 and 11, in which the additing position of the heterocyclic mercapto compound and azaindene compound was varied (comparison between Samples 201, 203 through 206), the samples which used Emulsions Em-1, 8, 9 and 10 to which were added the compounds in the formation of their grains show little or no difference in the fog density and gradation, while Sample 206 which used Emulsion Em-11 to which were added the compounds immediately after the formation of its grains shows a high fog density and a low gradation, which emulsion is almost the same in this respect as Sample 207 which used Emulsion Em-19 to which was added no azaindene compound in the ripening process thereof.

From the above results it is apparent that, even if the adding manner of the restrainer of this invention to be added in the formation of grains is changed, the effect of this invention as given in Example-1 can be obtained as long as the restrainer is added during the period of the formation of grains, and even if the adding position of the restrainer to be added in the formation of grains is changed, the effect of this invention can be obtained likewise as long as the restrainer is added during the period of the formation of grains.

EXAMPLE 3

In this example, we investigated chiefly the effect according to types of the restrainer of this invention, types of the high-boiling solvent of this invention, and the combined use of the high-boiling solvent of this invention with non-invention high-boiling solvents.

On a polyethylene-laminated paper support were coated the following layers in order from the support side, whereby silver halide color photographic material Samples 301 to 319 were prepared.

| | |
|---|---|
| Layer 1: | |
| Gelatin | 1.20 g/m$^2$ |
| A silver halide emulsion comprising the emulsion prepared in the foregoing Preparation Examples (types of the emulsion are shown in Table 5) which is ripened for 100 minutes at 50° C. with gold-sulfur sensitization by the addition thereto of the optimum amounts of sodium thiosulfate and chloroauric acid and to which are then added $3.0 \times 10^{-4}$ mole/ml Ag of a methanol solution of a spectrally sensitizing dye (the following Compound (Z)) and $1.0 \times 10^{-3}$ mole/ml Ag of an aqueous solution of Compound (C) having the following structural formula. | 0.30 g/m$^2$ (silver equivalent) |
| High-boiling solvent (types of the solvent are shown in Table 5) | 0.50 g/m$^2$ |
| Coupler (C-1) | 0.80 g/m$^2$ |
| Layer 2: | |
| Gelatin | 0.50 g/m$^2$ |
| Sodium 2,4-dichloro-6-hydroxy-S-triazine (hardener) | 0.017 g/g of the gelatin |

Compound (C)

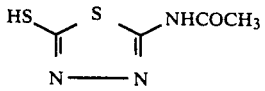

(C-1)

-continued

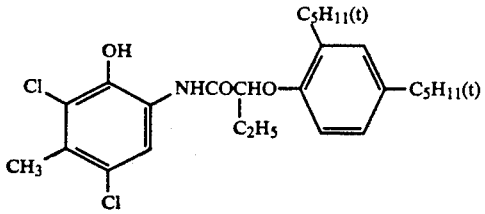

Sensitizing Dye Z

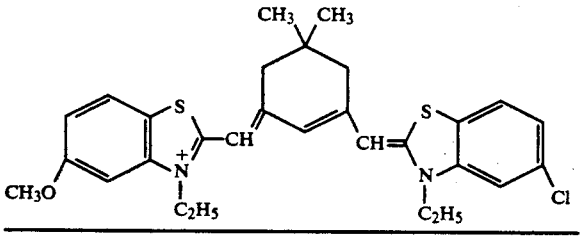

These obtained samples were each exposed and then processed in the same manner as in Example 1. In the processing each sample was color-developed for 45 seconds only because an adequate color density was obtained in this developing time.

The sensitometric results and the results of the light resistance of these samples obtained in similar manner to Example 1 are shown in Table 5.

TABLE 5

| Sample No. | Composition of sample: Emulsion used | Invention's restrainer added in grain formation | High-boiling solvent used | Sensitometric results: Fog | γ | Resistance to light (%) |
|---|---|---|---|---|---|---|
| 301 | Em-1 | (S-42) | H-6 (4.6) | 0.04 | 3.48 | 77 |
| 302 | Em-2 | (S-5) | H-6 | 0.04 | 3.50 | 77 |
| 303 | Em-3 | (S-6) | H-6 | 0.04 | 3.51 | 76 |
| 304 | Em-4 | (S-32) | H-6 | 0.04 | 3.49 | 78 |
| 305 | Em-5 | (S-70) | H-6 | 0.03 | 3.50 | 77 |
| 306 | Em-7 | (S-5) | H-6 | 0.03 | 3.48 | 76 |
| 307 | Em-13 | (S-5) | H-6 | 0.03 | 3.50 | 77 |
| 308 | Em-14 | (S-6) | H-6 | 0.04 | 3.50 | 77 |
| 309 | Em-15 | (S-32) | H-6 | 0.04 | 3.51 | 76 |
| 310 | Em-16 | (S-70) | H-6 | 0.04 | 3.49 | 76 |
| 311 | Em-17 | (S-42) | H-6 | 0.06 | 3.49 | 77 |
| 312 | Em-13 | (S-5) | H-5 (4.9) | 0.04 | 3.51 | 76 |
| 313 | Em-13 | (S-5) | H-12 (5.1) | 0.04 | 3.51 | 77 |
| 314 | Em-13 | (S-5) | H-13 (4.5) | 0.04 | 3.49 | 76 |
| 315 | Em-13 | (S-5) | H-6 (90% by wt) HBP (10% by wt) (5.3) | 0.05 | 3.52 | 71 |
| 316 | Em-13 | (S-5) | H-6 (90% by wt) TCP*1 (10% by wt) (5.5) | 0.05 | 3.53 | 72 |
| 317 | Em-19 | (—) | H-6 | 0.17 | 2.55 | 76 |
| 318 | Em-20 | (—) | H-6 | 0.18 | 2.59 | 76 |
| 319 | Em-20 | (—) | DBP (6.4) | 0.18 | 3.50 | 54 |

Note:
*1TCP: Tricresyl phosphate

From the results shown in Table 5 it is apparent that, by comparison of Comparative Samples 317 and 318, comprising the non-invention emulsion which contains the high-boiling solvent of this invention but has no restrainer of this invention added in the formation of grains, with Samples 301 to 311 for this invention, in which the silver halide composition and type of the restrainer of this invention were varied, the samples of this invention have conspicuous fog densities and are contrasty.

By comparison between Samples 301 through 311, there is little or n difference in the sensitometric results between the silver chloride contents of 97 mole % (Em-13 to 17) and 100 mole % (Em-1 to 5), showing that they are low in the fog density and contrasty on the whole, and so with the case where the type of the restrainer is varied.

However, by comparison between Samples 301 and 311 comprising Em-1 and Em-7, respectively, different in the pH in the formation of grains, Sample 301, which comprises Em-1, is slightly lower in the fog density, so that this is preferred.

By comparison between Samples 307, 312 through 316, using the emulsion of this invention but differing in the type of the high-boiling solvent of this invention or using the non-invention high-boiling solvent in combination, they all show almost no difference in the gradation, but Samples 315 and 316, using the non-invention high-boiling solvent in combination, are found to be slightly inferior in their dye image's resistance to light.

EXAMPLE 4

On a polyethylene-laminated paper support were coated the following layers in order from the support side, whereby silver halide color photographic material Samples 401 to 404 were prepared.

| Layer 1: | |
|---|---|
| Gelatin | 1.20 g/m² |
| Blue-sensitive silver halide emulsion*1 (silver equivalent: the same shall apply hereinafter) | 0.32 g/m² |
| High-boiling solvent (types of the solvent are | 0.50 g/m² |

-continued

| | |
|---|---|
| shown in Table 7) | |
| Yellow Coupler (Y-1) | 0.80 g/m$^2$ |
| The following Compound (N) | 0.02 g/m$^2$ |
| Layer 2: | |
| Gelatin | 0.70 g/m$^2$ |
| Antiirradiation Dye (AI-1) | 10 mg/m$^2$ |
| Antiirradiation Dye (AI-2) | 5 mg/m$^2$ |
| The following Compound (N) | 0.05 g/m$^2$ |
| Layer 3: | |
| Gelatin | 1.25 g/m$^2$ |
| Green-sensitive silver halide emulsion*2 | 0.22 g/m$^2$ |
| High-boiling solvent (types of the solvent are shown in Table 7) | 0.30 g/m$^2$ |
| Magenta Coupler (M-1) | 0.62 g/m$^2$ |
| The following Compound (N) | 0.015 g/m$^2$ |
| Layer 4: | |
| Gelatin | 1.20 g/m$^2$ |
| The following Compound (N) | 0.05 g/m$^2$ |
| Layer 5: | |
| Gelatin | 1.40 g/m$^2$ |
| Red-sensitive silver halide emulsion*3 | 0.20 g/m$^2$ |
| High-boiling solvent (types of the solvent are shown in Table 7) | 0.20 g/m$^2$ |
| Cyan Coupler (C-1) | 0.45 g/m$^2$ |
| The following Compound (N) | 0.01 g/m$^2$ |

-continued

| | |
|---|---|
| Layer 6: | |
| Gelatin | 1.0 g/m$^2$ |
| High-boiling Solvent (H-6) | 0.2 g/m$^2$ |
| Ultraviolet Absorbing Agent (UV-1) | 0.3 g/m$^2$ |
| The following Compound (N) | 0.05 g/m$^2$ |
| Layer 7: | |
| Gelatin | 0.5 g/m$^2$ |
| The following Compound (N) | 0.05 g/m$^2$ |

Note: *1, *2, *3:

The respective light-sensitive silver halide emulsions were prepared in the following manner:

The emulsion prepared in Preparation Examples (types of the emulsion are shown in Table 7) is ripened for 100 minutes at 50° C. with gold-sulfur sensitization treatment by the addition thereto of sodium thiosulfate and chloroauric acid, and to this sensitized emulsion are then added a methanol solution of an appropriate spectrally sensitizing dye (types and adding amounts are given in Table 6) according to each individual color sensitivity (less-soluble one of the sensitizing dyes is dissolved by adding a proper amount of DMF thereto) and $1.0 \times 10^{-3}$ mole/mole Ag of an aqueous solution of Compound (D) having the following structural formula:

Compound (D)

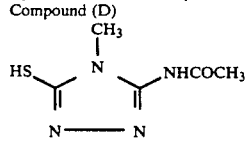

TABLE 6

| Sensitive to | Sensitizing dye | Adding amount (mol/ml Ag) |
|---|---|---|
| Blue | 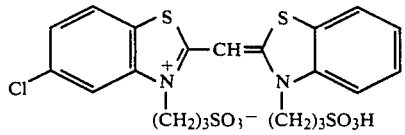 | $3.2 \times 10^{-4}$ |
| Green | 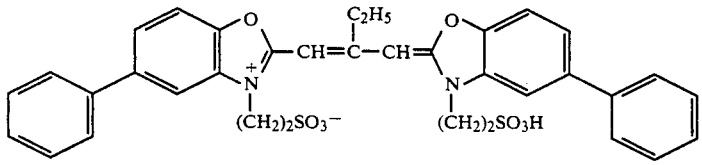 | $1.5 \times 10^{-4}$ |
| Red | 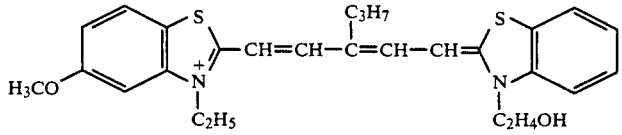 | $4.0 \times 10^{-5}$ |

Compound (N)

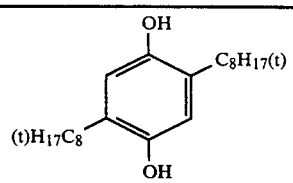

(AI-1)

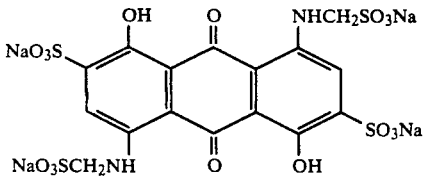

(AI-2)

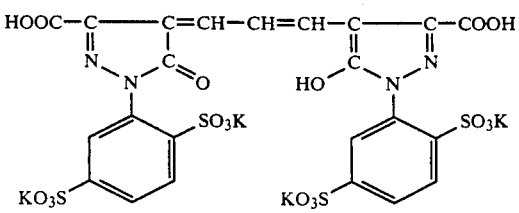

TABLE 6-continued (UV-1)

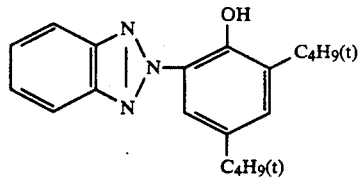

In addition. sodium 2,4-dichloro-6-hydroxy-S-triazine as a hardening agent was incorporated so as to be in an amount of 0.17 g per gram of gelatin into each of Layers 2, 4 and 7.

Each of the thus obtained samples was exposed and then processed in similar manner to Example 1.

In the processing, each sample was color-developed for 45 seconds only because an adequate color density was obtained in this color developing time.

The sensitometric results and the results of the resistance to light of these samples obtained in similar manner to Example 1 are as shown in Table 7.

TABLE 7

| Sample No.* | Emulsion used | High-boiling solvent used | Sensitometric results Fog | Sensitometric results γ | Resistance to light (%) |
|---|---|---|---|---|---|
| 401 (Inv.) | Em-2 | H-6 (4.6) | 0.03 | 3.30 | 78 |
| | Em-2 | H-6 | 0.04 | 3.58 | 75 |
| | Em-2 | H-6 | 0.03 | 3.63 | 78 |
| 402 (Comp.) | Em-2 | DBP (6.4) | 0.10 | 3.32 | 52 |
| | Em-2 | DBP | 0.11 | 3.61 | 48 |
| | Em-2 | DBP | 0.11 | 3.68 | 54 |
| 403 (Comp.) | Em-19 | H-6 | 0.17 | 2.18 | 77 |
| | Em-19 | H-6 | 0.18 | 2.56 | 74 |
| | Em-19 | H-6 | 0.17 | 2.61 | 78 |
| 404 (Comp.) | Em-19 | DBP | 0.17 | 3.25 | 53 |
| | Em-19 | DBP | 0.18 | 3.56 | 48 |
| | Em-19 | DBP | 0.18 | 3.65 | 54 |

Note:
*Each sample was measured with respect to the blue-, green- and red-sensive layers, whose results are shown in order from the top inside the row for each sample.

Even in these multilayer light-sensitive material samples, similar results to those of the single-layer light-sensitive material samples evaluated in Examples 1 to 3 were obtained. That is, Samples 402 and 404 containing the non-invention high-boiling solvent are inferior in the image's preservability and also high in the fog density. Sample 403, which contains the high-boiling solvent of this invention but uses the non-invention emulsion. although excellent in the dye image's preservability, is high in the fog density and conspicuously low in the contrast.

Sample 401 for the invention is excellent in the dye image's preservability and further shows an extremely small fog and no deterioration of the gradation. Furthermore, the sample, since its adequate density is obtained in the 45-second color development, is considered to be excellent in the aptitude to rapid processing. Consequently, the silver halide color photographic material of this invention is apparently capable of being processed rapidly as well as of producing a dye image which is excellent in the stability, extremely low in the fog density, and contrasty.

What is claimed is:

1. A light-sensitive silver halide photographic material comprising a reflective support having thereon at least one light-sensitive silver halide emulsion layer containing silver chloride or silver chlorobromide emulsion of which silver chloride content is not less than 90 mole %, said silver chloride or silver chlorobromide emulsion having been prepared by the addition of a heterocyclic mercapto compound or an azaindene compound during the period of formation of silver halide grains contained therein, a dye-forming coupler and a high-boiling organic solvent of which dielectric constant is not more than 6.

2. The light-sensitive silver halide photographic material of claim 1, wherein said heterocyclic mercapto compound is represented by the following Formula [I]:

Formula [I]

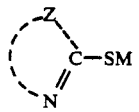

wherein Z is a group of atoms necessary to form a 5 or 6-member heterocyclic ring which may be condensed, and M is a hydrogen atom, an alakali metal atom, or an ammonium group.

3. The light-sensitive silver halide photographic material of claim 2, wherein said heterocyclic ring is selected from the group consisting of a pyridine, a pyrimidine, an imidazole, a benzimidazole, a naphthoimidazole, an oxazole, a benzoxazole, a naphthoxazole, a thiazole, a benzothiazole, a naphthothizaole, a selenazole, a benzoselenazole, a naphthoselenazole, a triazole, an oxadiazole, a thiadiazole, a triazine, a tetrazole, a purine and an azaindene, provided that these groups may have a substituent and that the azainden has a -SM group, in which M is a hydrogen atom, an alakali metal atom, or an ammonium group.

4. The light-sensitive silver halide photographic material of claim 1, wherein said heterocyclic mercapto compound is selected from a group of compounds represented by the formula [II], [III] or [IV];

Formula [II]

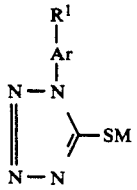

wherein Ar is selected from the group consisting of a phenyl, a naphthyl or a cyclohexyl group; $R^1$ is an organic group substitutable to the Ar group or a hydrogen atom; M is a hydrogen atom, an alkali metal atom or an ammonium group;

Formula [III]

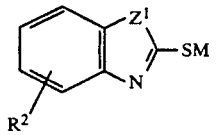

wherein $Z^1$ is selected from the group consisting of a sulfur atom, oxygen atom, selenium atom and a

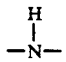

group; and $R^2$ is a substitutable organic group or a hydrogen atom; and M is same as defined in Formula II]; and Formula [IV]

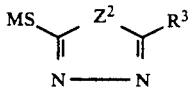

wherein $Z^2$ is selected from the group consisting of a sulfur atom, oxygen atom, selenium atom and a>-N—$R^4$ group, in which $R^4$ is selected from the group consisting of a hydrogen atom, an alkyl group, an alkenyl group, a cycloalkyl group, an aryl, an aralkyl group, a —$COR^5$group, a —$SO_2R^5$ group, a —$NHCOR^5$ and a —$NHSO_2R^5$ group, wherein $R^5$ is an alkyl or an aryl group; and $R^3$ is a substitutable organic group; and M is same as defined in Formula [II].

5. The light-sensitive silver halide photographic material of claim 1, whrein said azaindene compound is selected from tetrazaindene compounds having Formula (1), (2), (3), (4) or (5);

Formula (1)

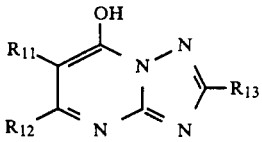

Formula (2)

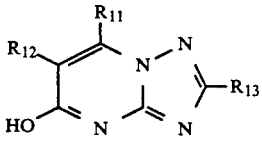

Formula (3)

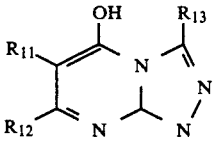

Formula (4)

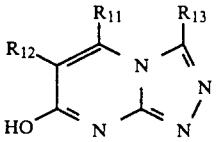

-continued

Formula (5)

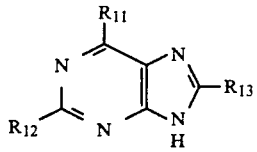

whereinabove $R_{11}$, $R_{12}$ and $R_{13}$ are independently selected from the group consisting of a hydrogen atom, a halogen atom, an amino group or a derivative thereof, an alkyl group or a derivative thereof, an aryl group or a derivative thereof, a cycloalkyl group or a derivative thereof and a —CONH-$R_{14}$ group, in which $R_{14}$ is selected from the group consisting of a hydrogen atom, an alkyl or a derivative thereof, an amino group or a derivative thereof, a halogen atom, a cycloalkyl group or a derivative thereof, an aryl group or a derivative thereof, provided that the $R_{11}$ and $R_{12}$ may be combined with each other to form a 5 to 7-membered carbocyclic or a heterocyclic ring.

6. The light-sensitive silver halide photographic material of claim 1, wherein said at least one light-sensitive silver halide emulsion layer contains a silver chloride-containing emulsion of which silver chloride content is 90 to 100 mole %.

7. The light-sensitive silver halide photographic material of claim 6, wherein said at silver chloride content is 95 to 100 mole %.

8. The light-sensitive silver halide photographic material of claim 1, wherein said silver halide grains have an average grain size of 0.2 to 1.6 μm.

9. The light-sensitive silver halide photographic material of claim 8, wherein said an average grain size is 0.25 to 1.2 μm.

10. The light-sensitive silver halide photographic material of claim 1, wherein said silver halide emulsion is a monodisperse emulsion of which coefficient of variation given in terms of the following formula is not more than 0.15;

$$\text{Coefficient of variation} = \frac{S}{\bar{r}}$$

wherein $\bar{r}$ is the average grain size and S is given in the following formula;

$$\text{Standard deviation } S = \sqrt{\frac{(r - \bar{r})^2 ni}{ni}}$$

in which ri represents the grain size of each individual grain, and the ni represents the number of the individual grains having the grain size ri.

11. The light-sensitive silver halide photographic material of claim 1, wherein said high-boiling organic solvent has a dielectric constant is not more than 1.9 to 6.

12. The light-sensitive silver halide photographic material of claim 1, wherein said high-boiling organic solvent is selected from the group consisting of an ester, an organic acid amide, a ketones and a hydrocarbon compound.

13. The light-sensitive silver halide photographic material of claim 1, wherein said high-boiling organic solvent is one represented by the formula [HA] or [HB];

Formula [HA]

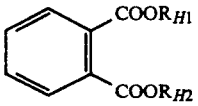

wherein $R_{H1}$ and $R_{H2}$ are independently selected from the group consisting of an alkyl, an alkenyl and an aryl group, provided that sum of the carbon atoms contained in $R_{H1}$ and $R_{H2}$ is from 9 to 32;

Formula [HB]

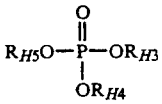

wherein $R_{H3}$, $R_{H4}$ and $R_{H5}$ are independently selected from the group consisting of an alkyl group, an alkenyl group and an aryl group, provided that the sum of the carbon atoms contained in $R_{H3}$, $R_{H4}$ and $R_{H5}$ is from 24 to 54.

14. The light-sensitive silver halide photographic material of claim 1, wherein said dye-forming coupler is selected from the group consisting of a benzoylacetanilide-type yellow dye-forming coupler, a pivaloylacetanilide-type yellow dye-forming coupler, a 5-pyrazolone-type magenta dye-forming coupler, a pyrazoloazole-type magenta dye-forming coupler, a phenol-type cyan dye-forming coupler and a naphthol-type cyan dye-forming coupler.

* * * * *